US008648793B2

(12) United States Patent
Mihara et al.

(10) Patent No.: US 8,648,793 B2
(45) Date of Patent: Feb. 11, 2014

(54) IMAGE DISPLAY APPARATUS, DISPLAY CONTROL APPARATUS, AND DISPLAY CONTROL METHOD

(71) Applicant: Fujitsu Limited, Kawasaki (JP)

(72) Inventors: Motonobu Mihara, Kawasaki (JP); Masayoshi Shimizu, Hadano (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 13/869,002

(22) Filed: Apr. 23, 2013

(65) Prior Publication Data

US 2013/0241950 A1 Sep. 19, 2013

Related U.S. Application Data

(63) Continuation of application No. PCT/JP2010/071357, filed on Nov. 30, 2010.

(51) Int. Cl.
*G09G 3/36* (2006.01)
*G09G 5/02* (2006.01)

(52) U.S. Cl.
USPC ..... 345/102; 345/589

(58) Field of Classification Search
None
See application file for complete search history.

(56) References Cited

U.S. PATENT DOCUMENTS 4,739,392 A * 4/1988 Ueda et al. ..... 348/225.1
2007/0171182 A1* 7/2007 Mizuno et al. ..... 345/102
2011/0122109 A1* 5/2011 Nose ..... 345/207
2011/0254819 A1* 10/2011 Yamagishi et al. ..... 345/207
2012/0154629 A1* 6/2012 Horiuchi ..... 348/226.1

FOREIGN PATENT DOCUMENTS

| | | |
|---|---|---|
| JP | 07-117559 | 5/1995 |
| JP | 2005-121997 | 5/2005 |
| JP | 2006-285064 | 10/2006 |
| JP | 2007-094097 | 4/2007 |
| JP | 2007-310096 | 11/2007 |
| JP | 2011-117997 | 6/2011 |
| WO | WO-2010/089970 | 8/2010 |

OTHER PUBLICATIONS

International Search Report, mailed in connection with PCT/JP2010/071357and mailed Mar. 8, 2011.

* cited by examiner

*Primary Examiner* — Kee M Tung
*Assistant Examiner* — Nurun N Flora
(74) *Attorney, Agent, or Firm* — Fujitsu Patent Center

(57) ABSTRACT

An illuminance change detector obtains detected illuminance values from a plurality of illuminance detectors, and determines whether the illuminance value detected by each illuminance detector changed from an illuminance range to another illuminance range. When the illuminance value detected by at least one of the plurality of illuminance detectors changed from the illuminance range to the other illuminance range, an image quality control unit sets different timing to change an image quality adjustment value for a display image from an image quality adjustment value corresponding to the illuminance range to an image quality adjustment value corresponding to the other illuminance range, depending on how many of the illuminance values detected by the illuminance detectors changed from the illuminance range to the other illuminance range.

15 Claims, 18 Drawing Sheets

162 CONTROL VALUE TABLE

| ILLUMINANCE VALUE | CONTROL VALUE (COMBINING RATIO b) |
|---|---|
| C4 ≤ ILLUMINANCE | B5 |
| C3 ≤ ILLUMINANCE < C4 | B4 |
| C2 ≤ ILLUMINANCE < C3 | B3 |
| C1 ≤ ILLUMINANCE < C2 | B2 |
| ILLUMINANCE < C1 | B1 |

FIG. 6

161 TIME CONSTANT TABLE

| ILLUMINANCE CHANGE FLAG | ILLUMINANCE CHANGE TIME | TIME CONSTANT |
|---|---|---|
| 1 | ILLUMINANCE CHANGE TIME ≤ D1 | D1 |
| 0 | | D1+E1 |
| 1 | D1 < ILLUMINANCE CHANGE TIME ≤ D2 | D2 |
| 0 | | D2+E2 |
| 1 | D2 < ILLUMINANCE CHANGE TIME | D3 |
| 0 | | D3+E3 |

FIG. 9

161 TIME CONSTANT TABLE

| ILLUMINANCE CHANGE FLAG | ILLUMINANCE CHANGE TIME | BRIGHTNESS CHANGE FLAG | TIME CONSTANT |
|---|---|---|---|
| 1 | ILLUMINANCE CHANGE TIME ≤ D1 | 0 | D1 |
| | | 1 | D1+F1 |
| 0 | | – | D1+E1 |
| 1 | D1 < ILLUMINANCE CHANGE TIME ≤ D2 | – | D2 |
| 0 | | – | D2+E2 |
| 1 | D2 < ILLUMINANCE CHANGE TIME ≤ D3 | – | D3 |
| 0 | | – | D3+E3 |

FIG. 13

161 TIME CONSTANT TABLE

| ILLUMINANCE CHANGE FLAG | ILLUMINANCE CHANGE AMOUNT | TIME CONSTANT |
|---|---|---|
| 1 | G1 ≤ ILLUMINANCE CHANGE AMOUNT | H1 |
| 0 | | H1+I1 |
| 1 | G2 ≤ ILLUMINANCE CHANGE AMOUNT < G1 | H2 |
| 0 | | H2+I2 |
| 1 | ILLUMINANCE CHANGE AMOUNT < G2 | H3 |
| 0 | | H3+I3 |

FIG. 16

IMAGE DISPLAY APPARATUS, DISPLAY CONTROL APPARATUS, AND DISPLAY CONTROL METHOD

CROSS-REFERENCE TO RELATED APPLICATION

This application is a continuation application of International Application PCT/JP2010/071357 filed on Nov. 30, 2010 which designated the U.S., the entire contents of which are incorporated herein by reference.

FIELD

The embodiments discussed herein are related to an image display apparatus, a display control apparatus and a display control method.

BACKGROUND

The screens of display apparatuses such as liquid crystal displays are difficult to view under very bright environments. Especially, with respect to display apparatuses that are used outdoors, such as displays for car navigation systems, the screens are likely to get difficult to view due to large variations in surrounding brightness. To always make the screen of a display apparatus comfortable to view, there is known a technique of detecting the illuminance around the display apparatus with an illuminance sensor and adjusting the brightness of the screen according to the detection result of the illuminance sensor.

There are some techniques to adjust the brightness of a screen according to a detection result of an illuminance sensor. For example, one of the techniques is to determine based on detected values obtained from a plurality of illuminance sensors whether to change the brightness of the backlight of a liquid crystal display. This technique does not needlessly change the brightness of the backlight in response to a transient variation in the illuminance. Another technique is to, based on a detected value obtained from an illuminance sensor, gradually dim the backlight when it becomes dark suddenly, and to swiftly brighten the backlight when it becomes bright suddenly. This technique changes the brightness of the backlight so as to fit the adaptation of the human visual system.

Please see, for example, Japanese Unexamined Patent Publications Nos. 2005-121997, 2007-94097, and 07-117559.

By the way, the illuminance around a display apparatus varies according to changes in the surrounding environment of the display apparatus. To make a screen comfortable to view, a display apparatus needs to be adjusted in different ways, depending on how the surrounding environment changes. For example, how to adjust a screen so that people feel comfortable to view the screen is different between the case where the environment suddenly changes from a sunny or cloudy environment to a dark environment like a place in a tunnel or indoor parking area and the case of moving into the shadow of the clouds or buildings from a sunny environment. Therefore, it is desired that a display apparatus is adjusted so that the screen is always comfortable to view under various surrounding conditions.

SUMMARY

According to one aspect, there is provided an image display apparatus that includes: a display unit configured to display an image; an image quality adjustment unit configured to adjust an image quality of the display unit; an illuminance change detector configured to obtain a detected illuminance value from each of a plurality of illuminance detectors that detect illuminance values outside the display unit, and to determine whether the illuminance value detected by each illuminance detector changed from one illuminance range to another illuminance range; and an image quality control unit configured to set, upon determining by the illuminance change detector that the illuminance values detected by one or more of the plurality of illuminance detectors changed from the one illuminance range to the other illuminance range, different timing to change an image quality adjustment value set in the image quality adjustment unit from an image quality adjustment value corresponding to the one illuminance range to an image quality adjustment value corresponding to the other illuminance range, depending on how many of the illuminance values detected by the plurality of illuminance detectors changed from the one illuminance range to the other illuminance range.

The object and advantages of the invention will be realized and attained by means of the elements and combinations particularly pointed out in the claims.

It is to be understood that both the foregoing general description and the following detailed description are exemplary and explanatory and are not restrictive of the invention.

BRIEF DESCRIPTION OF DRAWINGS

FIG. 6 illustrates an example of data stored in a control value table;

FIG. 9 illustrates an example of data stored in a time constant table;

FIG. 13 illustrates an example of data stored in a time constant table according to the third embodiment;

FIG. 16 illustrates an example of data stored in a time constant table according to the fourth embodiment;

DESCRIPTION OF EMBODIMENTS

Figure 1:
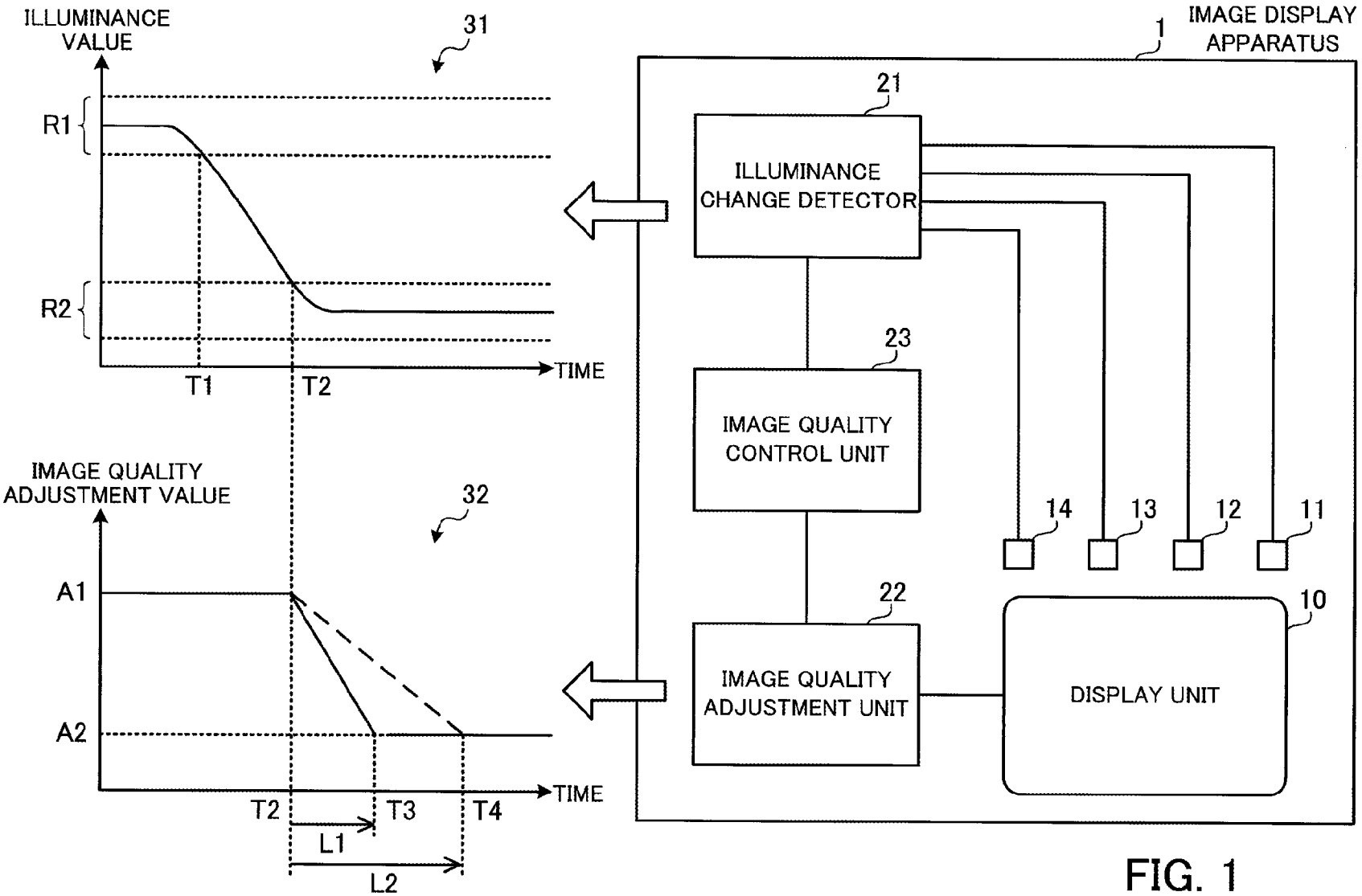
FIG. 1 illustrates an example of a functional configuration of an image display apparatus according to a first embodiment.

Several embodiments will be described below with reference to the accompanying drawings, wherein like reference numerals refer to like elements throughout. Features of the embodiments may be combined unless they exclude each other.

First Embodiment

FIG. 1 illustrates an example of a functional configuration of an image display apparatus according to a first embodiment.

An image display apparatus 1 illustrated in FIG. 1 is able to display an image on a display unit 10, and adjust the image quality of the display unit 10 according to the surrounding illuminance. This image display apparatus 1 includes the display unit 10, a plurality of illuminance detectors 11 to 14, an illuminance change detector 21, image quality adjustment unit 22, and image quality control unit 23.

Each of the illuminance detectors 11 to 14 detects the illuminance around the display unit 10. The illuminance detectors 11 to 14 are mounted at positions that are spaced from each other and enable detection of the illuminance of light incident to the display surface of the display unit 10, for example. However, these positions are not specifically limited.

Further, the image display apparatus 1 of FIG. 1 is provided with the four illuminance detectors 11 to 14, for example. However, two to any number of illuminance detectors may be provided. In addition, the illuminance detectors 11 to 14 may be provided external to the image display apparatus 1.

The illuminance change detector 21 obtains a detected illuminance value from each of the illuminance detectors 11 to 14, and determines whether the illuminance value detected by the illuminance detector 11 to 14 changed from one illuminance range (hereinafter, referred to as "illuminance range R1") to another (hereinafter, referred to as "illuminance range R2").

The image quality adjustment unit 22 adjusts the image quality of the display unit 10. The image quality control unit 23 controls an image quality adjustment process performed by the image quality adjustment unit 22, by changing an image quality adjustment value set in the image quality adjustment unit 22. Basically, under the control of the image quality control unit 23, the image quality adjustment unit 22 adjusts the image quality according to the illuminance around the display unit 10 so as to make an image on the display unit 10 comfortable to view.

For example, the image quality adjustment unit applies a compression gain specified by the image quality control unit 23 to the low frequency components of an input image to be displayed on the display unit 10, and also applies an amplification gain specified by the image quality control unit 23 to the high frequency components of the input image. In this approach, higher compression and amplification gains are applied as the illuminance around the display unit 10 is higher, which increases the contrast in both the shadow part and the highlight part of the display image, thereby improving the visibility of the display image.

Alternatively, the image quality adjustment unit 22 may change the brightness of an input image to be displayed on the display unit 10. In this approach, the brightness of the input image is set higher as the illuminance around the display unit 10 is higher, thereby improving the visibility of the display image. In the case where the display unit 10 is a liquid crystal display device, the image quality adjustment unit 22 may change the brightness of a display image by controlling the brightness of the backlight of the liquid crystal display device.

The image quality control unit 23 controls an image quality adjustment value set in the image quality adjustment unit 22 according to a detection result obtained by the illuminance change detector 21. Basically, when the illuminance detected by the illuminance detectors 11 to 14 vary, the image quality control unit 23 continuously or discretely changes the image quality adjustment value set in the image quality adjustment unit 22, from an image quality adjustment value corresponding to the previous illuminance to an image quality adjustment value corresponding to the current illuminance. In this connection, the image quality control unit 23 changes the image quality adjustment value set in the image quality adjustment unit 22 in different ways depending on whether or not the illuminance change detector 21 detects similar variations in the illuminance values detected by all of the illuminance detectors 11 to 14.

More specifically, in the case where an illuminance value detected by at least one of the illuminance detectors 11 to 14 changed from an illuminance range R1 to another illuminance range R2, the image quality control unit 23 sets different timing to change the image quality adjustment value set in the image quality adjustment unit 22 to an image quality adjustment value corresponding to the illuminance range R2, depending on how many of the illuminance values detected by the illuminance detectors changed from the illuminance range R1 to the illuminance range R2. Through this process, the image quality control unit 23 adjusts an image quality according to variations in the illuminance around the display unit 10, so as to make an image on the display unit 10 more natural to view.

For example, the image quality control unit 23 sets a longer time period to change the image quality adjustment value set in the image quality adjustment unit 22 to the image quality adjustment value corresponding to the illuminance range R2 in the case where the illuminance values detected by some of the illuminance detectors 11 to 14 changed from the illuminance range R1 to the illuminance range R2, than in the case where the illuminance values detected by all of the illuminance detectors 11 to 14 changed from the illuminance range R1 to the illuminance range R2.

The following describes an image quality adjustment control process performed by the image quality control unit 23 with reference to graphs 31 and 32 illustrated on the left side in FIG. 1. The graph 31 represents an example of variations in the illuminance value detected by an illuminance detector. Assume now that the graph 31 relates to the illuminance value detected by the illuminance detector 11. On the other hand, the graph 32 represents an example of variations in the image quality adjustment value that is set in the image quality adjustment unit 22 under the control of the image quality control unit 23. Adjustment values A1 and A2 in the graph 32 are set in the image quality adjustment unit 22 when a detected illuminance value falls in the illuminance ranges R1 and R2, respectively.

The illuminance value detected by the illuminance detector 11 stays in the illuminance range R1 before timing T1. Under this state, the image quality control unit 23 sets the adjustment value A1 in the image quality adjustment unit 22. Then, the illuminance value detected by the illuminance detector 11 becomes lower than the illuminance range R1 at timing T1, and falls in the illuminance range R2 at timing T2. Therefore, the illuminance change detector 21 determines that the illuminance value detected by the illuminance detector 11 changed from the illuminance range R1 to the illuminance range R2 at timing T2, and notifies the image quality control unit 23 of this change.

The image quality control unit 23, having received this notification, determines based on the detection result obtained from the illuminance change detector 21 whether or not the illuminance values detected by the other illuminance detectors changed from the illuminance range R1 to the illuminance range R2, as with that detected by the illuminance detector 11. Then, the image quality control unit 23 sets different timing to change the image quality adjustment value set in the image quality adjustment unit 22 to the adjustment value A2 corresponding to the illuminance range R2, according to the determination result.

In the case where the illuminance values detected by all of the illuminance detectors 11 to 14 changed from the illuminance range R1 to the illuminance range R2, the image quality control unit 23 sets a time period L1 to change the image quality adjustment value set in the image quality adjustment unit 22 to the adjustment value A2 corresponding to the illuminance range R2. In this case, the image quality control unit 23 changes the image quality adjustment value set in the image quality adjustment unit 22 from the adjustment value A1 to the adjustment value A2 over the time period L1 from timing T2.

On the other hand, in the case where the illuminance value detected by at least one of the illuminance detectors 12 to 14 did not change from the illuminance range R1 to the illuminance range R2, the image quality control unit 23 sets a time period L2 longer than the time period L1, to change the image quality adjustment value set in the image quality adjustment unit 22 to the adjustment value A2. In this case, the image quality control unit 23 changes the image quality adjustment value set in the image quality adjustment unit 22 from the adjustment value A1 to the adjustment value A2 over the time period L2 from timing T2. In the graph 32, the change of the image quality adjustment value set in the image quality adjustment unit 22 over the time period L2 is represented by a dotted line.

In the case where the illuminance values detected by all of the illuminance detectors 11 to 14 changed from the illuminance range R1 to the illuminance range R2, the illuminance around the display unit 10 is expected to have changed rapidly. For example, this case may be a case where a vehicle with the image display apparatus 1 enters a dark place like a place in a tunnel or indoor parking area. On the other hand, in the case where the illuminance value detected by at least one of the illuminance detectors 12 to 14 did not change from the illuminance range R1 to the illuminance range R2, the illuminance around the display unit 10 is expected to have changed gradually. For example, this case may be a case where a vehicle with the image display apparatus 1 moves from an environment like a place with sunlight to a place in the shadow of the clouds or buildings. In the case where the illuminance around the display unit is expected to have changed gradually, the image quality adjustment value set in the image quality adjustment unit 22 is changed gradually, as represented by the dotted line of the graph 32, which makes a display image on the display unit 10 more natural to view.

Therefore, in the image display apparatus 1, the image quality control unit 23 controls an image quality adjustment value according to variations in the illuminance around the display unit 10 to adjust an image quality, so as to make an image on the display unit 10 more natural to view.

In this connection, in the example of the graph 32, the image quality control unit 23 controls a time period to continuously change the image quality adjustment value set in the image quality adjustment unit 22 from the adjustment value A1 to the adjustment value A2. Alternatively, the image quality control unit 23 may be designed to control timing of changing the image quality adjustment value from the adjustment value A1 to the adjustment value A2. In this case, the image quality control unit 23 changes the image quality adjustment value set in the image quality adjustment unit 22 from the adjustment value A1 to the adjustment value A2 at either timing T3 or T4, depending on whether or not the illuminance values detected by the other illuminance detectors 12 to 14 changed from the illuminance range R1 to the illuminance range R2, as with that detected by the illuminance detector 11, for example.

Figure 2:
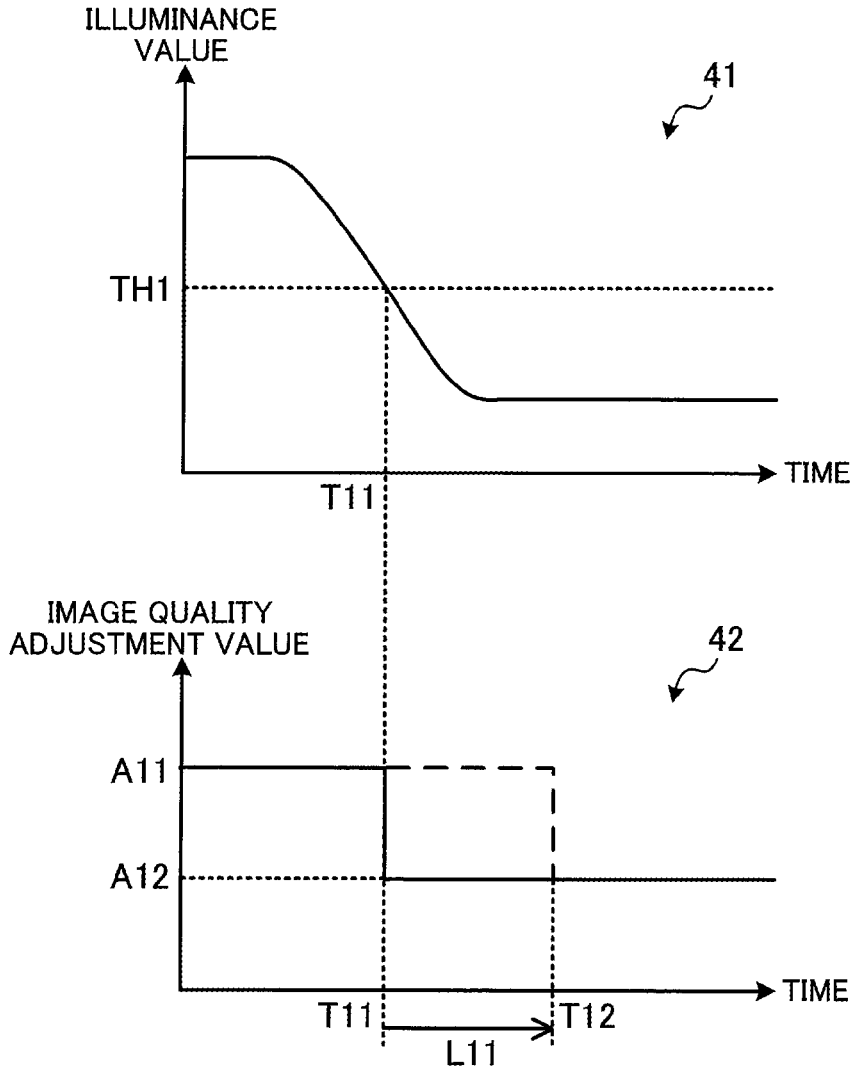
FIG. 2 is graphs representing another example of variations in illuminance value and image quality adjustment value.

In addition, the graph 31 represents an example where the illuminance ranges R1 and R2 are separated from each other. Alternatively, the illuminance ranges R1 and R2 may be set to continue. The following describes the case where the illuminance ranges R1 and R2 continue. FIG. 2 is graphs representing another example of variations in illuminance value and image quality adjustment value.

A graph 41 of FIG. 2 represents an example of variations in the illuminance value detected by the illuminance detector 11 in the case where the illuminance value changes from higher than a threshold TH1 to lower than the threshold TH1. It is assumed that the above-described illuminance range R1 corresponds to a value higher than or equal to the threshold TH1, and the above-described illuminance range R2 corresponds to a value lower than the threshold TH1.

On the other hand, a graph 42 represents an example of variations in the image quality adjustment value set in the image quality adjustment unit 22 under the control of the image quality control unit 23. In this graph 42, the adjustment value A11 is an image quality adjustment value to be used when a detected illuminance value is higher than or equal to the threshold TH1, and the adjustment value A12 is an image quality adjustment value to be used when the detected illuminance value is lower than the threshold TH1.

The illuminance change detector 21 detects that the illuminance value detected by the illuminance detector 11 became lower than the threshold TH1 at timing T11, and notifies the image quality control unit 23 of this change. The image quality control unit 23, having received this notification, determines whether or not the illuminance values detected by the other illuminance detectors 12 to 14 became lower than the threshold TH1 at timing T11, as with that detected by the illuminance detector 11. Then, the image quality control unit 23 sets a different delay time for changing the image quality adjustment value set in the image quality adjustment unit 22 from the adjustment value A11 to the adjustment value A12, according to the determination result.

For example, in the case where the illuminance values detected by all of the illuminance detectors 11 to 14 became lower than the threshold TH1 at timing T11, the image quality control unit 23 sets a delay time to zero, so as to immediately change the image quality adjustment value set in the image quality adjustment unit 22 to the adjustment value A12. On the other hand, in the case where the illuminance value detected by at least one of the illuminance detectors 12 to 13 did not become lower than the threshold TH1 at timing T11, the image quality control unit 23 delays timing of changing the image quality adjustment value set in the image quality adjustment unit 22 to the adjustment value A12 by a predetermined time period L11. The graph 42 represents, by a dotted line, the change of the image quality adjustment value set in the image quality adjustment unit 22 in the case where a delay time is set to the time period L11.

As is seen in the graph 42, an image quality adjustment value is changed with delay when the illuminance around the display unit 10 is expected to change gradually, which makes it possible to change the image quality of the display unit 10 more naturally.

Second Embodiment

Figure 3:
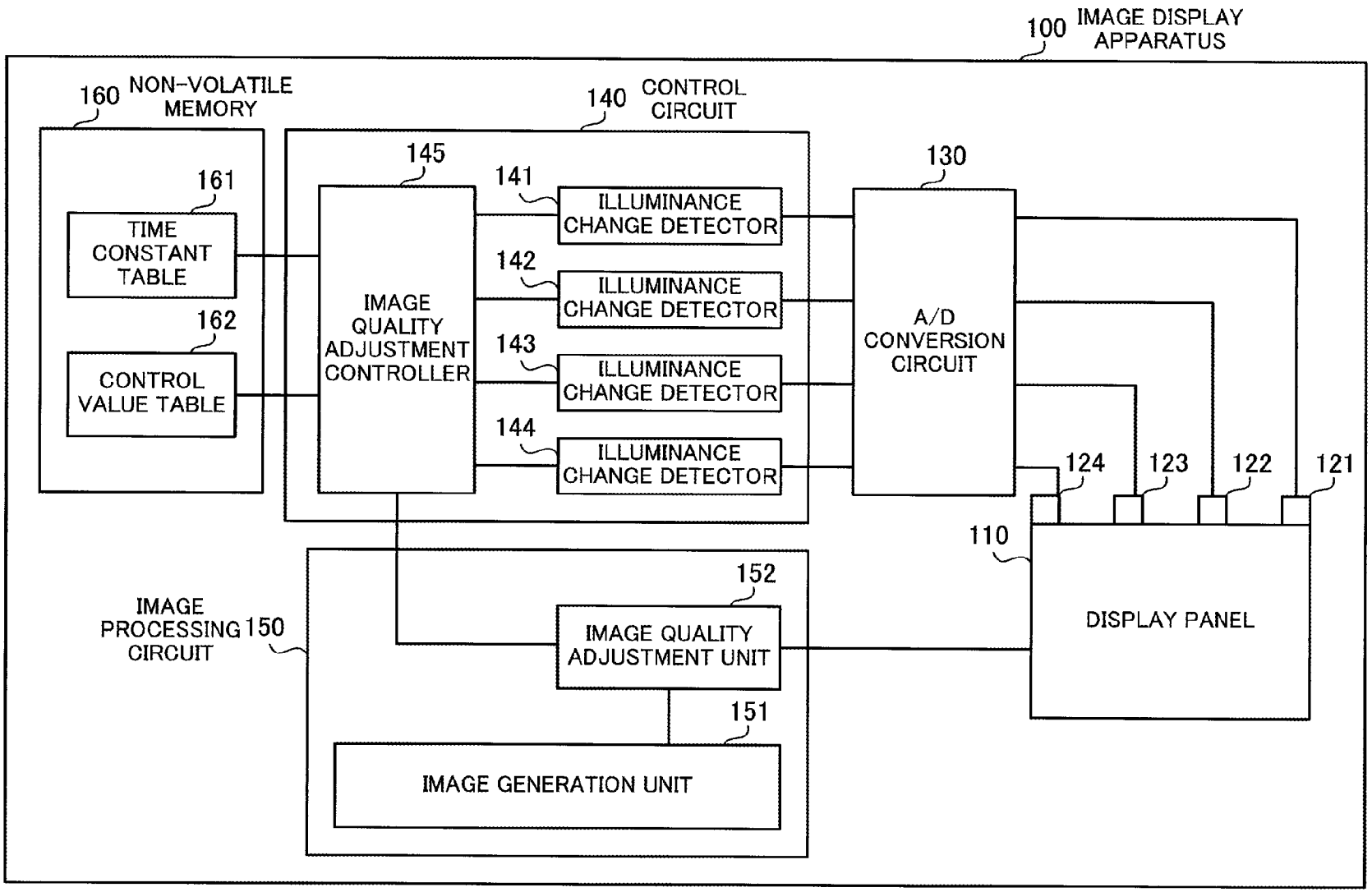
FIG. 3 is an example of a functional configuration of an image display apparatus according to a second embodiment.

FIG. 3 is an example of a functional configuration of an image display apparatus according to a second embodiment.

An image display apparatus 100 illustrated in FIG. 3 includes a display panel 110, illuminance sensors 121 to 124, analog-to-digital (A/D) conversion circuit 130, control circuit 140, image processing circuit 150, and non-volatile memory 160. For example, this image display apparatus 100 is implemented as a car navigation system or a component thereof.

The display panel 110 displays an image based on an image signal output from the control circuit 140, and is implemented as a liquid crystal panel, organic Electroluminescence (EL) panel, or the like.

Each of the illuminance sensors 121 to 124 detects the illuminance around the display panel 110, and outputs the detection result as an analog signal. Referring to the example of FIG. 3, the illuminance sensors 121 to 124 are mounted at the top of the display panel 110, but may be mounted at other places.

In this connection, the illuminance sensors 121 to 124 may be provided external to the image display apparatus 100. For example, when the image display apparatus 100 is used as a component of a car navigation system, the illuminance sensors 121 to 124 may be not only mounted on the casing of the display panel 110 but also separately mounted at the head portion of a vehicle such as around a driver seat, a passenger seat, a rearview mirror, a side mirror, and headlights, the rear portion of the vehicle such as around taillights, and other places.

The A/D conversion circuit 130 converts an analog signal received from each of the illuminance sensors 121 to 124 to a digital signal, and outputs the digital signal to the control circuit 140.

The control circuit 140 controls an image quality adjustment process performed by the image processing circuit 150 by outputting a control value for the image quality adjustment process to the image processing circuit 150. The control circuit 140, for example, is implemented as a processor circuit such as a Central Processing Unit (CPU). In this case, processes performed by the control circuit 140 are performed by the CPU executing intended programs stored in the non-volatile memory 160, etc. In addition, some or all of the functions of the control circuit 140 may be implemented by using dedicated hardware circuits.

The image processing circuit 150 performs digital image processing to create an image to be displayed on the display panel 110 and to adjust the image quality of the image. For example, the image processing circuit 150 is implemented as a circuit dedicated for image processing, such as a Digital Signal Processor (DSP).

In this connection, the control circuit 140 and image processing circuit 150 may be implemented as an integrated processing circuit.

The non-volatile memory 160 stores data that is referenced by the control circuit 140 performing processing. The non-volatile memory 160 is implemented as a semiconductor memory such as a flash memory, etc. Alternatively, the functions of the non-volatile memory 160 may be implemented by using a Hard Disk Drive (HDD).

The following describes the processing functions of the image processing circuit 150. The image processing circuit 150 includes an image generation unit 151 and image quality adjustment unit 152.

The image generation unit 151 generates images to be displayed on the display panel 110. For example, when the image display apparatus 100 is used in a car navigation system, the image generation unit 151 generates a map screen, etc.

The image quality adjustment unit 152 performs an image quality adjustment process on an image signal received from the image generation unit 151, under the control of the control circuit 140, and outputs the resultant image signal to the display panel 110. The image quality adjustment unit 152 adjusts the image quality according to the illuminance around the display panel 110 so that a user can easily view the image displayed on the display panel 110. In this embodiment, as an example, the image quality adjustment unit 152 applies a compression gain to the low frequency components of an input image received from the image generation unit 151, and applies an amplification gain to the high frequency components of the input image, to thereby adjust the image quality.

The following describes the processing functions of the control circuit 140. The control circuit 140 includes illuminance change detectors 141 to 144 and an image quality adjustment controller 145.

The illuminance change detectors 141 to 144 receive digitalized detection signals from the illuminance sensors 121 and 124, respectively. Each of the illuminance change detectors 141 to 144 then detects based on the received detection signal whether the illuminance value detected by the corresponding illuminance sensor changed from a state where the illuminance value stayed at around a level to another state where the illuminance value stays at around another level. Hereinafter, a change from one state where an illuminance value detected by an illuminance sensor stays at around a level to another state where the illuminance value stays at around another level is called "illuminance state change". When detecting an illuminance state change, each of the illuminance change detectors 141 to 144 detects an "illuminance change time" indicating how long it took the illuminance value to change from one state to another, and outputs the illuminance change time to the image quality adjustment controller 145.

The image quality adjustment controller 145 outputs a control value to the image quality adjustment unit 152 based on the detection information received from the illuminance change detectors 141 to 144 in order to control the image quality adjustment process performed by the image quality adjustment unit 152. The image quality adjustment controller 145 refers to a time constant table 161 and control value table 162 stored in the non-volatile memory 160 when controlling the image quality adjustment process.

A "time constant" stored in the time constant table 161 indicates a time period for how long to take to change the control value set in the image quality adjustment unit 152 from a control value corresponding to a previous illuminance state to a control value corresponding to a new illuminance state, and this time constant is used when an illuminance state change is detected by at least one of the illuminance change detectors 141 to 144. The time constant table 161 stores such a time constant in association with each combination of an illuminance change time, which is output from the illuminance change detector 141 to 144, and an "illuminance change flag" indicating whether illuminance state changes were detected by all of the illuminance change detectors 141 to 144 or not.

The control value table 162 stores an illuminance value and a control value that is used by the image quality adjustment unit 152 to perform an appropriate image quality adjustment process based on the illuminance value, in association with each other.

Figure 4:
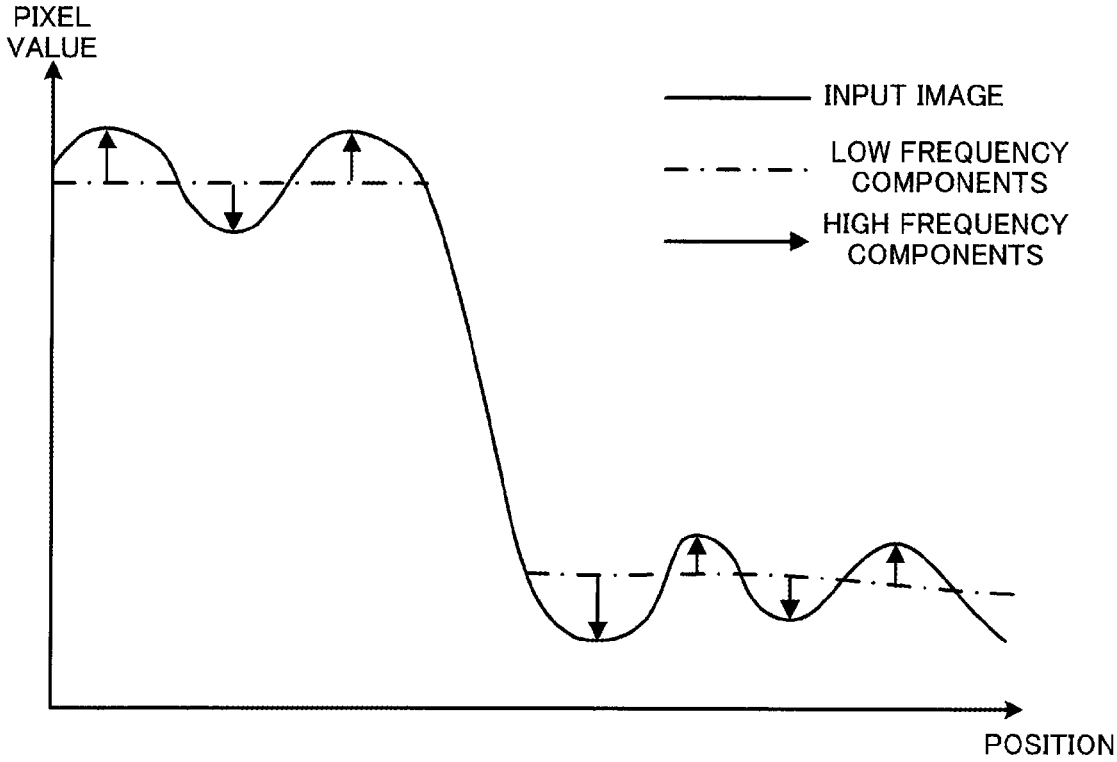
FIG. 4 illustrates an example of the pixel values of the low frequency components and high frequency components of a display image.
Figure 5:
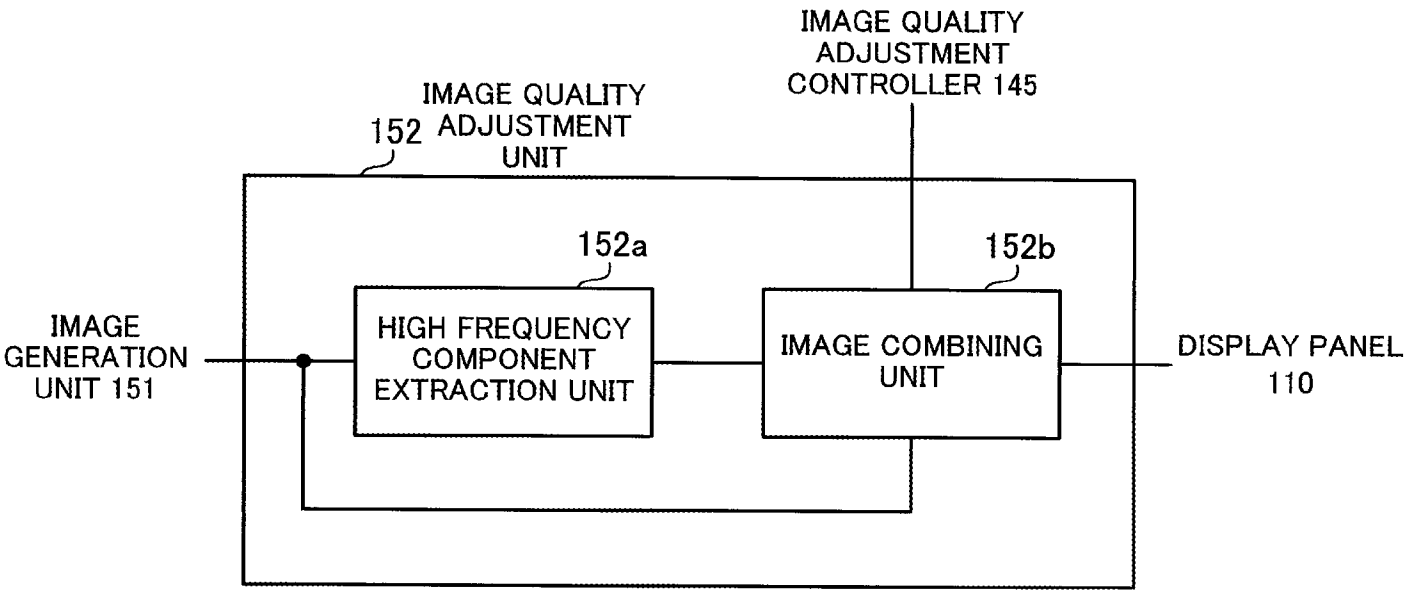
FIG. 5 illustrates an example of a functional block diagram of an image quality adjustment unit.

The following describes an image quality adjustment process performed by the image quality adjustment unit 152 with reference to FIGS. 4 and 5. FIG. 4 illustrates an example of the pixel values of the low frequency components and high frequency components of a display image.

For example, in the graph of FIG. 4, the horizontal axis represents the positions (horizontal coordinates) of pixels on a horizontal line in a display image, and the vertical axis represents the values of pixels located at the coordinates. The low frequency components and high frequency components obtained by decomposing the signal of a display image are represented by the dashed lines and arrows of FIG. 4, respectively.

The image quality adjustment unit 152 compresses the low frequency components of an input image and amplifies the high frequency components thereof, under the control of the image quality adjustment controller 145. Compressing the low frequency components of the input image means decreasing the levels of the dashed lines of FIG. 4. In addition, amplifying the high frequency components of the input image means lengthening the arrows of FIG. 4.

By compressing the low frequency components, the image quality adjustment unit 152 enlarges the dynamic ranges of both a part (so-called shadow part) with the low pixel values of the input image and a part (so-called highlight part) with the high pixel values of the input image. In addition, by amplifying the high frequency components, the image quality adjustment unit 152 makes clearer a subtle difference in grayscale between the shadow part and the highlight part of the input image. Therefore, as the illuminance around the display panel 110 becomes higher, the low frequency components of the input image are compressed and the high frequency components thereof are amplified, thereby improving the visibility of the image displayed on the display panel 110.

FIG. 5 illustrates an example of a functional block diagram of an image quality adjustment unit. The image quality adjustment unit 152 includes a high frequency component extraction unit 152*a* and an image combining unit 152*b*.

The high frequency component extraction unit 152*a* extracts high frequency components from an image signal received from the image generation unit 151. For example, the high frequency component extraction unit 152*a* includes a lowpass filter, and obtains a difference between an input image signal and the input image signal that has passed through the lowpass filter in order to thereby extract high frequency components. Further, the high frequency component extraction unit 152*a* amplifies the high frequency components extracted through the difference calculation by $\alpha$ times so as to enhance the difference in grayscale of the input image.

The image combining unit 152*b* combines the input image received from the image generation unit 151 and the image output from the high frequency component extraction unit 152*a*. The image combining unit 152*b* sets a combining ratio of an image output from the high frequency component extraction unit 152*a* to *b* ($0 \le b \le 1$), and sets a combining ratio of an image received from the image generation unit 151 to $(1-b)$. The combining ratio b is a control value that the image quality adjustment controller 145 outputs to the image quality adjustment unit 152.

Now, an input image from the image generation unit 151 is taken as X, the low frequency components of the input image X is taken as Y, and an image output from the high frequency component extraction unit 152*a* is taken as Z. In this case, an image output from the image combining unit 152*b* is represented as "$X(1-b)+aZ$". In addition, the high frequency components included in the input image X is represented as $Z/\alpha$, so a formula of "$X=Y+Z/\alpha$" is to be satisfied. From the above two formulas, an image output from the image combining unit 152*b* is represented as "$Y(1-b)+(Z/\alpha)(\alpha b+1-b)$". Therefore, a combining process performed by the image combining unit 152*b* is equivalent to combining a signal obtained by applying a compression gain $(1-b)$ to the low frequency components Y and a signal obtained by applying an amplification gain $(\alpha b+1-b)$ to the high frequency components $Z/\alpha$.

FIG. 6 illustrates an example of data stored in a control value table.

A control value table 162 stores a control value (that is, combining ratio b) for the image quality adjustment unit 152, in association with each illuminance range. The image quality adjustment controller 145 extracts a control value corresponding to an illuminance value detected by any one of the illuminance change detectors 141 to 144, from the control value table 162, and controls the image quality adjustment unit 152 with the extracted control value.

The control value table 162 of FIG. 6 stores a control value for each of five illuminance ranges by way of example. The illuminance ranges have a relationship of $C1<C2<C3<C4$, and the control values have a relationship of $B1<B2<B3<B4<B5$. According to this setting, the image quality adjustment controller 145 outputs a higher control value (that is, higher combining ratio b) to the image quality adjustment unit 152 in response to a higher illuminance value. That is, as the illuminance around the display panel 110 is higher, higher compression gain and higher amplification gain are set for the low frequency components and high frequency components of a display image, respectively, thereby keeping the visibility of the display image irrespective of the illuminance.

In this connection, the image quality adjustment controller 145 may change a control value linearly with an illuminance value, and outputs the control value to the image quality adjustment unit 152, instead of a discrete control value corresponding to an illuminance range. In this approach, the image quality adjustment controller 145 may calculate a control value with a formula, instead of using the control value table 162, for example.

Figure 7:
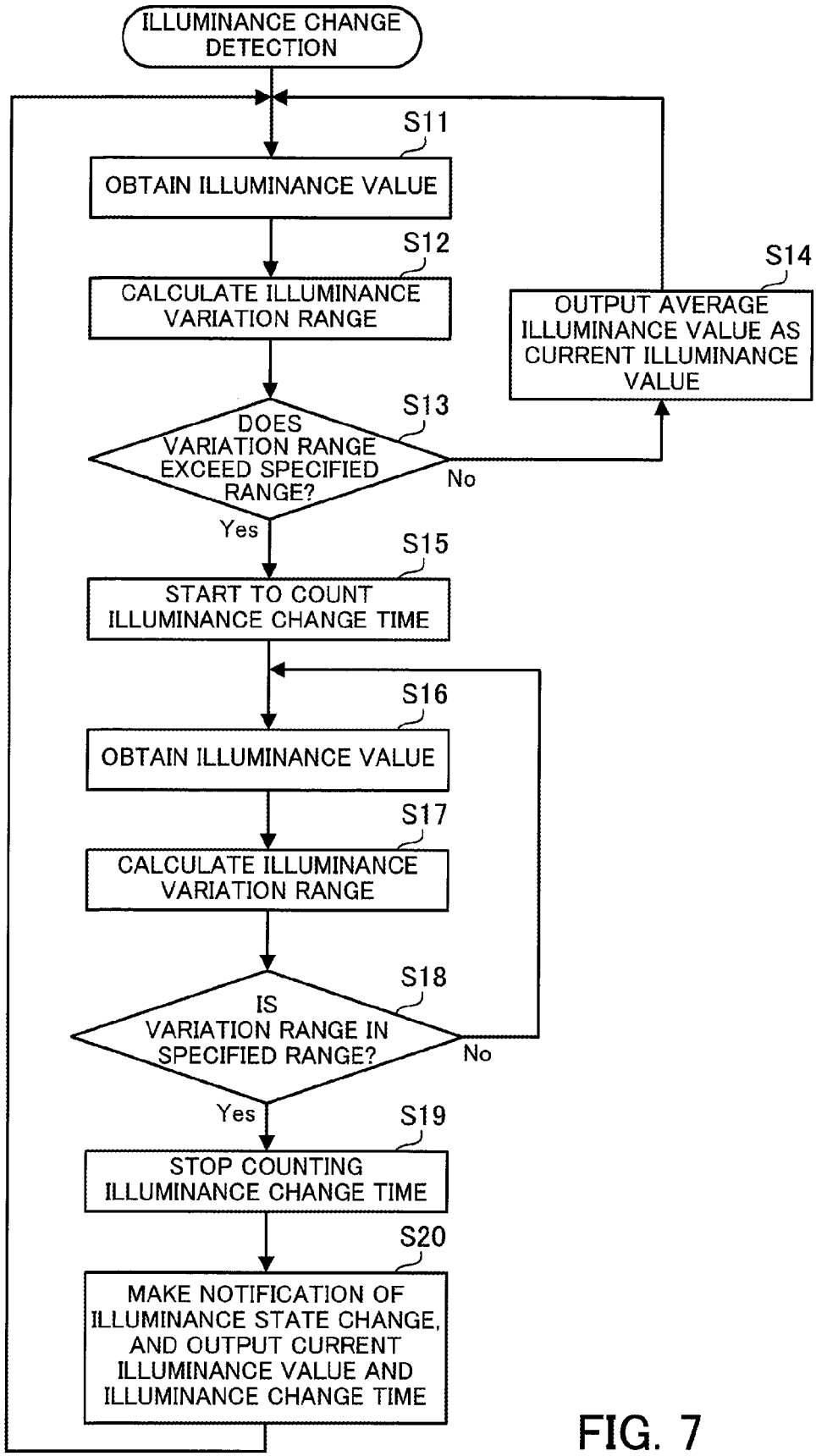
FIG. 7 is a flowchart illustrating how an illuminance change detector detects an illuminance change.

The following describes the operations of the illuminance change detectors 141 to 144 with reference to FIG. 7. Since the illuminance change detectors 141 to 144 operate in the same way, the following describes the operations of the illuminance change detector 141 with reference to FIG. 7.

FIG. 7 is a flowchart illustrating how an illuminance change detector detects an illuminance change.

(Step S11) The A/D conversion circuit 130 digitalizes a detection signal of an illuminance value detected by the illuminance sensor 121 at predetermined intervals, and outputs the resultant to the illuminance change detector 141. The illuminance change detector 141 obtains the digital value of the illuminance value detected by the illuminance sensor 121, from the A/D conversion circuit 130.

The illuminance change detector 141 holds a history of the latest illuminance values obtained in a fixed time period in an internal or external Random Access Memory (RAM, not illustrated) of the control circuit 140. At step S11, the illuminance change detector 141 updates the history by using the illuminance value obtained from the A/D conversion circuit 130.

(Step S12) The illuminance change detector 141 calculates a difference between the maximum and minimum illuminance values of the illuminance values stored as the history for the fixed time period, as an illuminance variation range.

(Step S13) The illuminance change detector 141 determines whether the illuminance variation range calculated at step S12 exceeds a specified range or not. If the illuminance variation range is in the specified range, the illuminance change detector 141 proceeds to step S14. If the illuminance variation range exceeds the specified range, the illuminance change detector 141 proceeds to step S15.

(Step S14) The illuminance change detector 141 calculates an average of the illuminance values stored as the history for the fixed time period, and outputs the calculated average value as the current illuminance value to the image quality adjustment controller 145. When receiving the current illuminance value output at step S14, the image quality adjustment controller 145 extracts a control value corresponding to the received current illuminance value from the control value table 162, and immediately outputs the extracted control value to the image quality adjustment unit 152, which will be described later.

In this connection, at step S14, instead of such an average illuminance value, the illuminance change detector 141 may output, to the image quality adjustment controller 145, any one of the maximum value and minimum value of the illuminance values obtained in the fixed time period, the mean value of the maximum and minimum illuminance values, and the latest illuminance value.

Step S11 is executed again after step S14.

(Step S15) The illuminance change detector 141 starts to count an illuminance change time from a count value of 0.

(Step S16) The illuminance change detector 141 obtains the digital value of an illuminance value detected by the illuminance sensor 121 from the A/D conversion circuit 130, and updates the history with the obtained illuminance value.

(Step S17) The illuminance change detector 141 calculates a difference between the maximum and minimum illuminance values of the illuminance values stored as the history for the fixed time period, as an illuminance variation range.

(Step S18) The illuminance change detector 141 determines whether the illuminance variation range calculated at step S17 is in a specified range or not. The specified range to be used in this determination may be the same as that used in the determination of step S13. If the illuminance variation range exceeds the specified range, the illuminance change detector 141 proceeds back to step S16. If the illuminance variation range is in the specified range, the illuminance change detector 141 proceeds to step S19.

(Step S19) The illuminance change detector 141 stops counting the illuminance change time.

(Step S20) The illuminance change detector 141 notifies the image quality adjustment controller 145 of the illuminance state change. The illuminance change detector 141 also calculates an average of the illuminance values stored as the history for the fixed time period, and outputs the calculated average value as the current illuminance value to the image quality adjustment controller 145. Furthermore, the illuminance change detector 141 outputs a count value obtained at the time of stopping the counting at step S19, as an illuminance change time to the image quality adjustment controller 145.

In this connection, the processing order of the notification of an illuminance state change, the output of a current illuminance value, and the output of an illuminance change time may not be limited to a specific order, and these processes may be performed in parallel. In addition, at step S20, instead of the average value of the illuminance values obtained in the fixed time period, the illuminance change detector 141 may output, to the image quality adjustment controller 145, any one of the maximum value and minimum value of the illuminance values obtained in the fixed time period, the mean value of the maximum and minimum values, and the latest illuminance value.

Then, step S11 is executed again.

According to the process of FIG. 7, the illuminance change detector 141 outputs the current illuminance value to the image quality adjustment controller 145 every time the illuminance change detector 141 receives an illuminance value from the A/D conversion circuit 130 while an obtained illuminance variation range does not exceed the specified range. When the illuminance change detector 141 detects at step S13 that the illuminance variation range for the fixed time period changed out of the specified range (that is, changed from a first illuminance range), the illuminance change detector 141 determines that the illuminance value varies relatively greatly, and starts to count an illuminance change time. Then, when the illuminance change detector 141 detects at step S18 that the illuminance variation range stays in a specified range (that is, falls in a second illuminance range), the illuminance change detector 141 determines that an illuminance state change occurred, and notifies the image quality adjustment controller 145 of this change. At this time, the illuminance change detector 141 outputs the time taken to change the illuminance state (illuminance change time) and the changed (current) illuminance value to the image quality adjustment controller 145.

Figure 8:
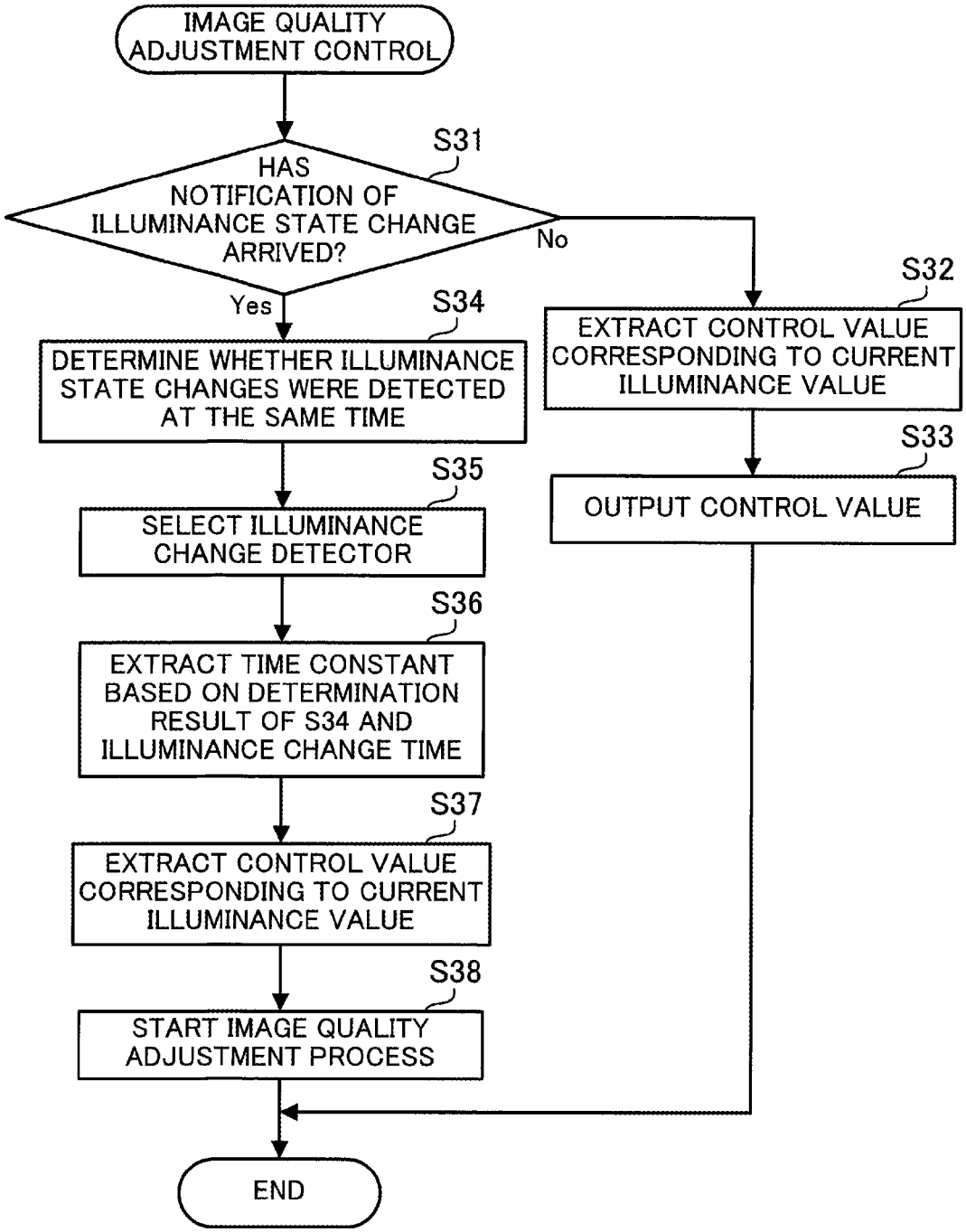
FIG. 8 is a flowchart illustrating how an image quality adjustment controller operates.

FIG. 8 is a flowchart illustrating how an image quality adjustment controller operates. This process of FIG. 8 is performed every time when the A/D conversion circuit 130 outputs a signal obtained by digitalizing a detection signal received from each of the illuminance sensors 121 to 124, to the corresponding illuminance change detector 141 to 144.

(Step S31) The image quality adjustment controller 145 determines whether a notification of illuminance state change has arrived from at least one of the illuminance change detectors 141 to 144. If such a notification has arrived, the image quality adjustment controller 145 proceeds to step S34. If no such a notification has arrived, the image quality adjustment controller 145 proceeds to step S32.

(Step S32) The image quality adjustment controller 145 receives the current illuminance value from each of the illuminance change detectors 141 to 144. This current illuminance value is output from each of the illuminance change detectors 141 to 144 at step S14 of FIG. 7.

The image quality adjustment controller 145 determines a current illuminance value to be used for extracting a control value, on the basis of the current illuminance values received from the illuminance change detectors 141 to 144. For example, the image quality adjustment controller 145 may calculate an average of the received current illuminance values, and take the calculated average value as the current illuminance value to be used for extracting a control value. Alternatively, the image quality adjustment controller 145 may use the illuminance value received from a predetermined one of the illuminance change detectors 141 to 144, as the current illuminance value to be used for extracting a control value. In the latter case, for example, one of the illuminance change detectors 141 to 144 may be selected according to the relative positions of the illuminance sensors 121 to 124 corresponding to the illuminance change detectors 141 to 144 with respect to the display panel 110. For example, the current illuminance value from the illuminance change detector corresponding to an illuminance sensor closest to the center of the display panel 110 may be taken as the current illuminance value to be used for extracting a control value.

The image quality adjustment controller 145 extracts a control value associated with the determined current illuminance value from the control value table 162.

(Step S33) The image quality adjustment controller 145 outputs the control value extracted at step S32, to the image quality adjustment unit 152, thereby changing an image quality adjustment value.

The above steps S32 and S33 are executed when the illuminance value detected by each of the illuminance change detectors 141 to 144 varies very little (that is, when the illuminance variation range is determined not to exceed the specified range at step S13 of FIG. 7). The illuminance value may increase or decrease little by little while varying little. Even in the case where the illuminance value increases or decreases little by little, the image quality adjustment value set in the image quality adjustment unit 152 is changed according to the illuminance value at steps S32 and S33.

(Step S34) The image quality adjustment controller 145 determines whether or not illuminance state changes were detected by all of the illuminance change detectors 141 to 144 at the same time. More specifically, for example, the image quality adjustment controller 145 determines whether or not all of the illuminance change detectors 141 to 144 made a notification of illuminance state change at the same time and outputted the same illuminance change time and the same current illuminance value.

(Step S35) It may be determined at step S34 that some of the illuminance change detectors 141 to 144 made a notification of illuminance state change at the same time but outputted different illuminance change times and different current illuminance values. In this case, the image quality adjustment controller 145 selects one of the illuminance change detectors that made the notification of illuminance state change, and uses the illuminance change time and current illuminance value received from the selected illuminance change detector, as data to be used for extracting a control value.

For example, a priority order may previously be given to the illuminance change detectors 141 to 144 so that the image quality adjustment controller 145 selects an illuminance change detector with the highest priority from the illuminance change detectors that made a notification of illuminance state change. The priority order may be given according to the relative positions of the illuminance sensors 121 to 124 corresponding to the illuminance change detectors 141 to 144 with respect to the display panel 110. For example, a higher priority is given to an illuminance change detector corresponding to an illuminance sensor closer to the center of the display panel 110.

(Step S36) As mentioned earlier, the time constant table 161 stores a time constant to be used for changing a control value set in the image quality adjustment unit 152, in association with each combination of an illuminance change time and an "illuminance change flag" indicating whether illuminance state changes were detected by all of the illuminance change detectors 141 to 144 or not. The image quality adjustment controller 145 extracts, from the time constant table 161, a time constant that matches the determination result obtained at step S34 and the illuminance change time received from the illuminance change detector selected at step S35.

(Step S37) The image quality adjustment controller 145 extracts, from the control value table 162, a control value associated with the current illuminance value output from the illuminance change detector selected at step S35.

(Step S38) The image quality adjustment controller 145 starts a process of changing a control value of the image quality adjustment unit 152 according to the time constant. More specifically, the image quality adjustment controller 145 changes, over a time period indicated by the time constant extracted at step S36, a control value to be output to the image quality adjustment unit 152 from a control value output to the image quality adjustment unit 152 immediately before starting the process of FIG. 8 to the control value extracted at step S37.

In this connection, the time constant extracted at step S36 may be longer than the intervals at which the A/D conversion circuit 130 outputs the digital value of an illuminance value to the illuminance change detectors 141 to 144. In this case, the image quality adjustment controller 145 may receive a new illuminance value from at least one of the illuminance change detectors 141 to 144 while changing the control value at step S38. If this happens, the image quality adjustment controller 145 may keep on changing the control value to be output to the image quality adjustment unit 152, ignoring the illuminance values coming from the illuminance change detectors 141 to 144, until the control value is changed to the control value extracted at step S37.

Alternatively, if the image quality adjustment controller 145 receives a notification of an illuminance state change from at least one of the illuminance change detectors 141 to 144 while changing the control value at step S38, the image quality adjustment controller 145 may stop changing the control value, and then execute steps S31 and S34 to S38. In this approach, the control value may be changed at newly executed step S38, starting with the control value that was output at the time of stopping to change of the control value.

FIG. 9 illustrates an example of data stored in a time constant table.

The time constant table 161 stores a time constant in association with each combination of an illuminance change flag and an illuminance change time range. An illuminance change flag indicates whether or not all of the illuminance change detectors 141 to 144 detected an illuminance state change at the same time. If it is determined at step S34 of FIG. 8 that illuminance state changes were detected by all of the illuminance change detectors 141 to 144 at the same time, the image quality adjustment controller 145 extracts a time constant associated with the illuminance change flag of "1" at step S36. If it is determined at step S34 of FIG. 8 that illuminance state changes were detected by only some of the illuminance change detectors 141 to 144, the image quality adjustment controller 145 extracts a time constant associated with the illuminance change flag of "0" at step S36.

In addition, referring to the time constant table 161 of FIG. 9, there are three ranges for illuminance change time, by way of example. The illuminance change time ranges have a relationship of D1<D2. In addition, the time constant table 161 of FIG. 9 sets the upper limit value of an illuminance change time range as a time constant associated with an illuminance change flag of "1", and sets a time period longer than the illuminance change time range, as a time constant associated with an illuminance change flag of "0". In this connection, D3 set in the time constant column is greater than D2.

By setting a time constant associated with an illuminance change flag of "0" longer than that associated with an illuminance change flag of "1" with respect to the same illuminance change time, as described above, the image quality adjustment value is changed more gradually. An illuminance change flag of "0" indicates that an illuminance state change occurred only in some of the illuminance sensors 121 to 124. Therefore, considering a wide area covering the positions of all of the illuminance sensors 121 to 124, the illuminance is expected to vary over a longer time period than the obtained illuminance change time. Or, the illuminance is expected to temporarily vary due to moving of the display panel 110 into the shadow of the clouds or buildings. In either case, more gradually changing the image quality adjustment value for a display image makes it possible to make the display image on the display panel 110 more natural to view.

In addition, a time constant may be set irrespective of the upper limit value of an illuminance change time range. That is, a greater time constant may be set for a longer illuminance change time, so that a time taken to change an image quality adjustment value becomes longer as an illuminance change time is longer. This enables the image quality adjustment to make an image on the display panel 110 more natural to view.

In this connection, E1, E2, and E3 in FIG. 9 may be set to the same value or may have a relationship of E1<E2<E3, for example. In addition, as time constant values, D1 may be set to several tens milliseconds, and D3+E3 may be set to several tens seconds, for example.

In addition, instead of D1, D2, and D3 that are fixed values, the value of an illuminance change time obtained at step S19 of FIG. 7 may be set as a time constant value. In this case, the image quality adjustment value is changed over an actual illuminance change time when an illuminance change flag is determined to be "1", and is changed over a time period longer than the actual illuminance change time when an illuminance change flag is determined to be "0".

In addition, according to the second embodiment, each of the illuminance change detectors 141 to 144 detects an illuminance change time taken to change an illuminance state, and the time constant table 161 stores an illuminance change time. Alternatively, an illuminance change rate at the time of an illuminance state change may be used, instead of such an illuminance change time. In this approach, referring to FIG. 7, each of the illuminance change detectors 141 to 144 detects an illuminance change amount indicating how much an illuminance value varies after it is determined at step S13 that the illuminance variation range exceeds the specified range until it is determined at step S18 that the illuminance variation range falls in the specified range. Then, each of the illuminance change detectors 141 to 144 divides the detected illuminance change amount by the illuminance change time detected at step S19 to calculate an illuminance change rate, and then outputs the illuminance change rate at step S20, instead of the illuminance change time.

The time constant table 161 stores a shorter time constant for a higher illuminance change rate. In addition, with respect to the same illuminance change rate, a longer time constant is set for an illuminance change flag of "0" than that for an illuminance change flag of "1". At step S36 of FIG. 8, the image quality adjustment controller 145 extracts, from the time constant table 161, a time constant that matches the determination result obtained at step S34 and the illuminance change rate output from the illuminance change detector selected at step S35. This approach produces the same effects as the above-described second embodiment.

Further, according to the above-described second embodiment, when an illuminance state change is detected, a control value for adjusting an image quality is gradually changed to a control value corresponding to the changed illuminance value over a time period indicated by a time constant. Alternatively, timing of changing the control value for adjusting an image quality to a control value corresponding to the changed illuminance value may be delayed by the time period indicated by a time constant. In this approach, at step S38 of FIG. 8, the image quality adjustment controller 145 outputs a control value extracted at step S37 after the time period indicated by the time constant passes, thereby changing an image quality adjustment value at a time.

Still further, at step S38 of FIG. 8, when the image quality adjustment controller 145 receives a notification of illuminance state change from at least one of the illuminance change detectors 141 to 144 before the time period indicated by a time constant passes, the image quality adjustment controller 145 may stop changing the control value, and execute steps S31 and S34 to S38. The following describes an example of how a control value is changed through this process, with reference to FIG. 10.

Figure 10:
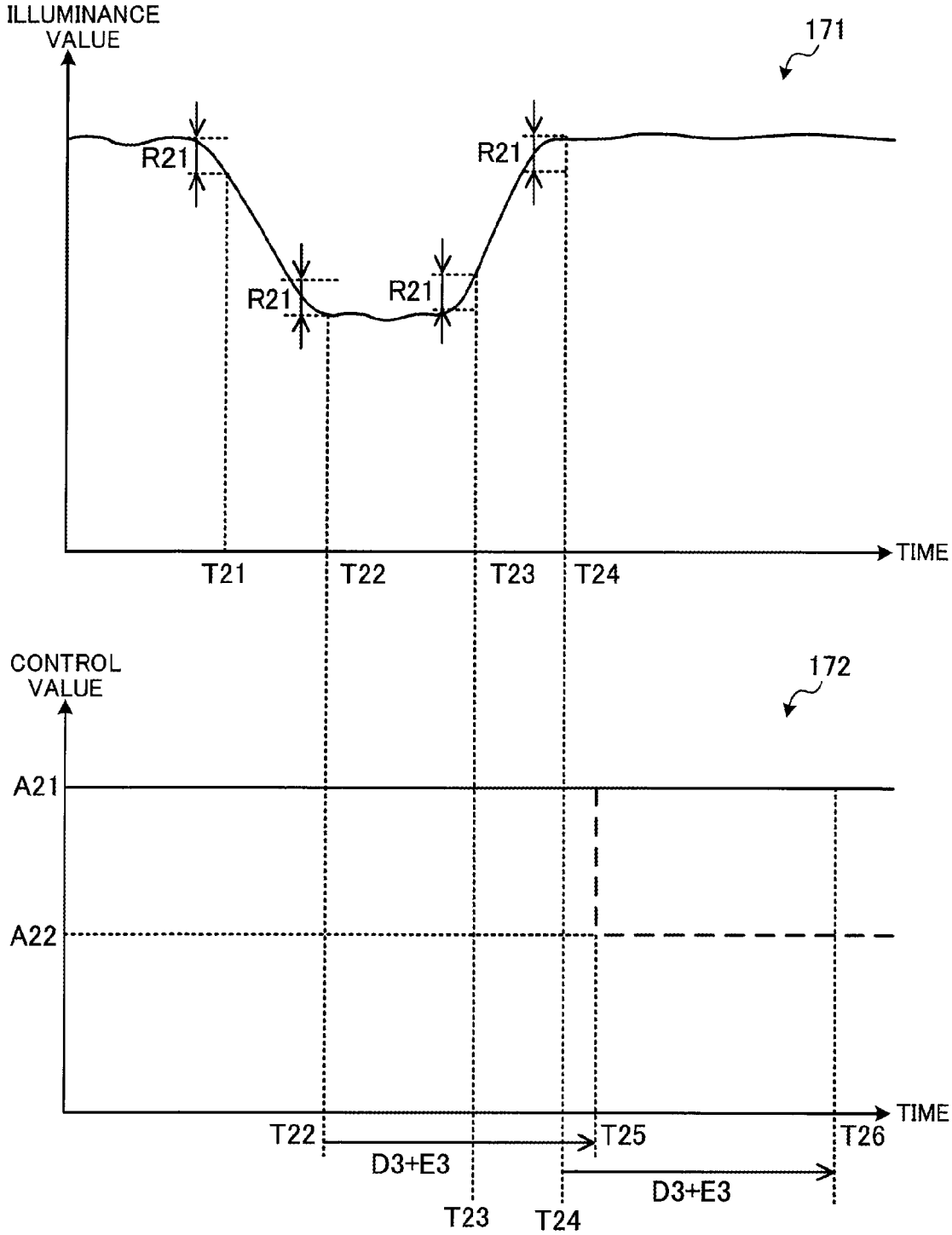
FIG. 10 is graphs illustrating an example of variations in illuminance value and control value for image quality adjustment.

FIG. 10 is graphs illustrating an example of variations in illuminance value and control value for image quality adjustment.

A graph 171 in FIG. 10 represents an example of variations in the illuminance value detected by one of illuminance change detectors. The graph 171 represents an example of a transient variation in the illuminance value. In addition, a graph 172 in FIG. 10 represents variations in a control value for image quality adjustment that is output from the image quality adjustment controller 145 when the illuminance value varies as illustrated in the graph 171.

As is seen from the graph 171, the illuminance change detector detects that a difference between the maximum and minimum illuminance values in a history changed out of a specified range R21 at timing T21, and the illuminance value rapidly decreased. The illuminance change detector then detects that the difference between the maximum and minimum illuminance values in the history fell into the specified range R21 at timing T22, and the illuminance change is stable. At this time, the illuminance change detector notifies the image quality adjustment controller 145 of the illuminance state change. In addition to this, the illuminance change detector outputs, to the image quality adjustment controller 145, the illuminance value obtained at timing T22 as the current illuminance value, and a time from timing T21 to T22 as an illuminance change time.

The image quality adjustment controller 145 extracts a time constant from the time constant table 161 on the basis of the illuminance change time and illuminance change flag at timing T22. Referring to the example of FIG. 10, a time constant, "D3+E3", is extracted at timing T22. The image quality adjustment controller 145 starts to count a time at timing T22, and does not change the control value A21 to be output to the image quality adjustment unit 152 for the time period of "D3+E3" until timing T25. If another notification of illuminance state change does not arrive from the illuminance change detector by timing T25, the image quality adjustment controller 145 changes, at timing T25, the control value to be output to the image quality adjustment unit 152 to the control value A22 corresponding to the illuminance value obtained at timing T22, as indicated by a dashed line of the graph 172.

Assume now that the illuminance change detector detects at timing T23 that a difference between the maximum and minimum illuminance values in the history exceeded the specified range R21 and the illuminance value increased rapidly, and also detects an illuminance state change at timing T24 prior to timing T25. In addition, assume that the illuminance value at timing T25 and the illuminance value before timing T21 both fall in the same illuminance range set in the control value table 162.

When the image quality adjustment controller 145 receives a notification of illuminance state change from the illuminance change detector at timing T24 while counting the time up to the time of changing the control value, the image quality adjustment controller 145 stops counting the time and forcibly ends the execution of step S38 of FIG. 8. Then, the image quality adjustment controller 145 repeats the process starting with step S31 of FIG. 8.

The image quality adjustment controller 145 extracts a time constant from the time constant table 161 on the basis of the illuminance change time and illuminance change flag at timing T24. Referring to the example of FIG. 10, a time constant "D3+E3" is extracted at timing T24. The image quality adjustment controller 145 starts counting a time at timing T24, and does not change the control value to be output to the image quality adjustment unit 152 from A21 till timing T26 at which the time period "D3+E3" ends.

Then, the image quality adjustment controller 145 intends to change the control value to A21 at timing T26. However, the current control value is A21, and therefore the control value to be output to the image quality adjustment unit 152 is not actually changed. As a result, the image quality of the display panel 110 is not changed from timing T21 to T26.

As described above, the time constant table 161 of FIG. 9 stores a longer time constant when a transient variation in an illuminance value is expected, for example, when an illuminance state change occurs only in some of the illuminance sensors 121 to 124. In the case where an illuminance state change occurs but this change is transient as the illuminance value is back close to the previous value within a relatively short time, a longer time constant, as illustrated in the example variations in illuminance value of the graph 171, prevents an image quality adjustment value from being changed, as illustrated in the graph 172. This makes it possible to prevent repeating the image quality adjustment in a short time in response to a transient variation in illuminance value, thereby reducing the occurrence of unnatural visibility of a screen.

Third Embodiment

The adaptation of the human visual system differs between the case of moving from a bright environment like a place with sunlight to a dark environment like a place in a tunnel and the case of moving from such a dark environment to such a bright environment. In general, the visual system takes several tens seconds to adapt from a bright place to a dark place, whereas the visual system takes a very short time to adapt from a dark place to a bright place. In the following third embodiment, a time to be taken to change an image quality is adjusted to fit the adaptation of the human visual system.

An image display apparatus according to the third embodiment may basically be configured as illustrated in FIG. 3. Therefore, the following description refers to FIG. 3. Different features from the second embodiment are that each of illuminance change detectors 141 to 144 is designed to detect whether an illuminance value increased or decreased, a time constant table 161 stores a different time constant for a "brightness change flag" indicating an increase or decrease in an illuminance value, and an image quality adjustment controller 145 determines a control value taking the brightness change flag into account.

Figure 11:
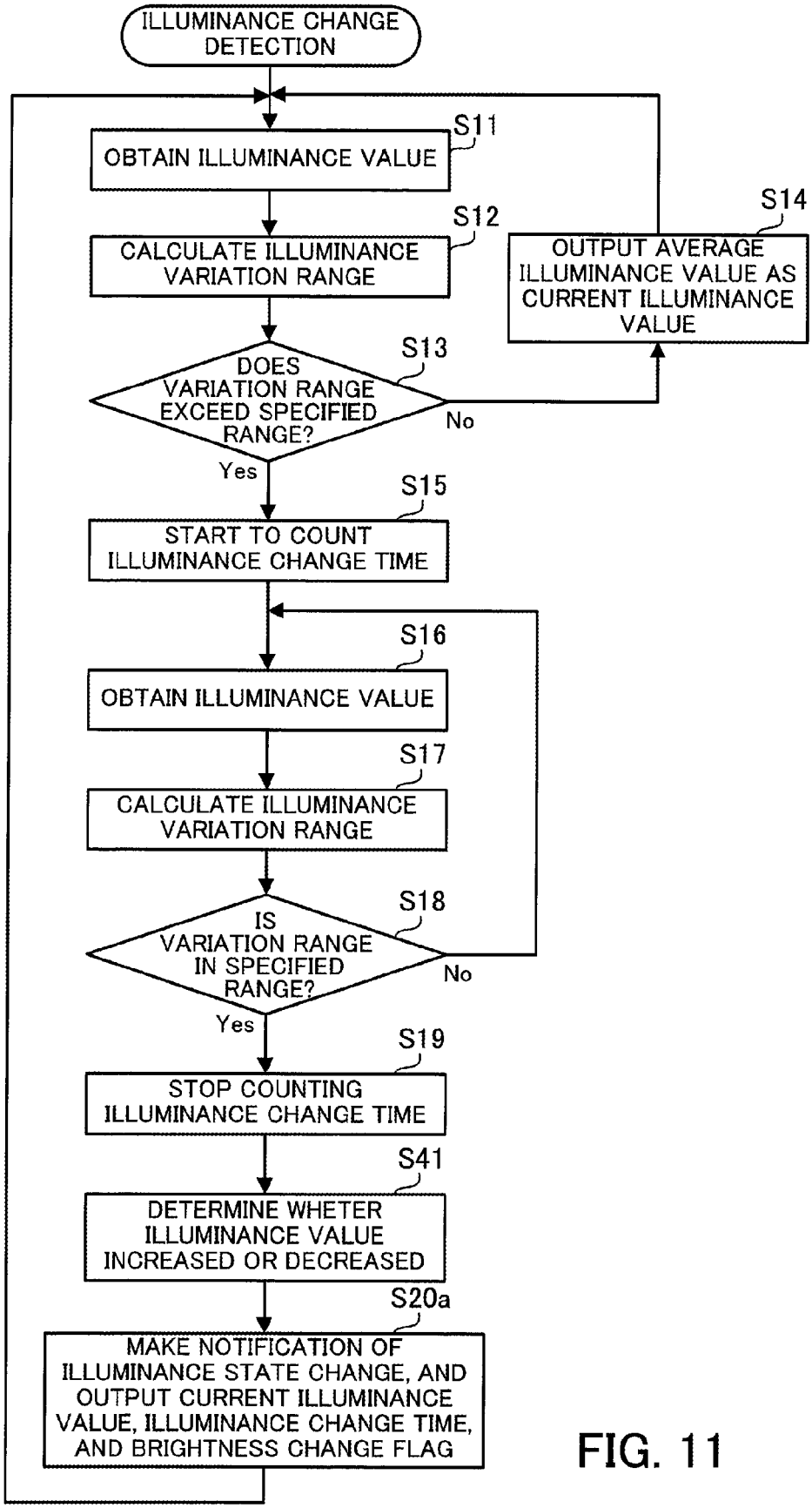
FIG. 11 is a flowchart illustrating a process performed by an illuminance change detector according to a third embodiment.

FIG. 11 is a flowchart illustrating a process performed by an illuminance change detector according to the third embodiment.

Similarly to FIG. 7, FIG. 11 will be described using the illuminance change detector 141 as a representative of the illuminance change detectors 141 to 144. In addition, in FIG. 11, the same reference numerals as in FIG. 7 are applied to the same processing steps, and only different processing steps from FIG. 7 will be described. In place of step S20 of FIG. 7, steps S41 and S20*a* are executed in the process of FIG. 11.

(Step S41) After detecting an illuminance state change (S18) and stopping counting of an illuminance change time (S19), the illuminance change detector 141 determines whether the illuminance value increased or decreased. This determination is made based on the illuminance values obtained most recently at steps S11 and S16. In this connection, steps S19 and S41 of FIG. 11 may be executed in parallel.

(Step S20*a*) The illuminance change detector 141 notifies the image quality adjustment controller 145 of an illuminance state change, and also outputs the current illuminance value and illuminance change time to the image quality adjustment controller 145, as in step S20 of FIG. 7. In addition, the illuminance change detector 141 outputs a brightness change flag based on the determination result obtained at step S41, to the image quality adjustment controller 145. The illuminance change detector 141 sets the brightness change flag to "1" when the illuminance value decreased, and on the other hand, sets the brightness change flag to "0" when the illuminance value increased.

Figure 12:
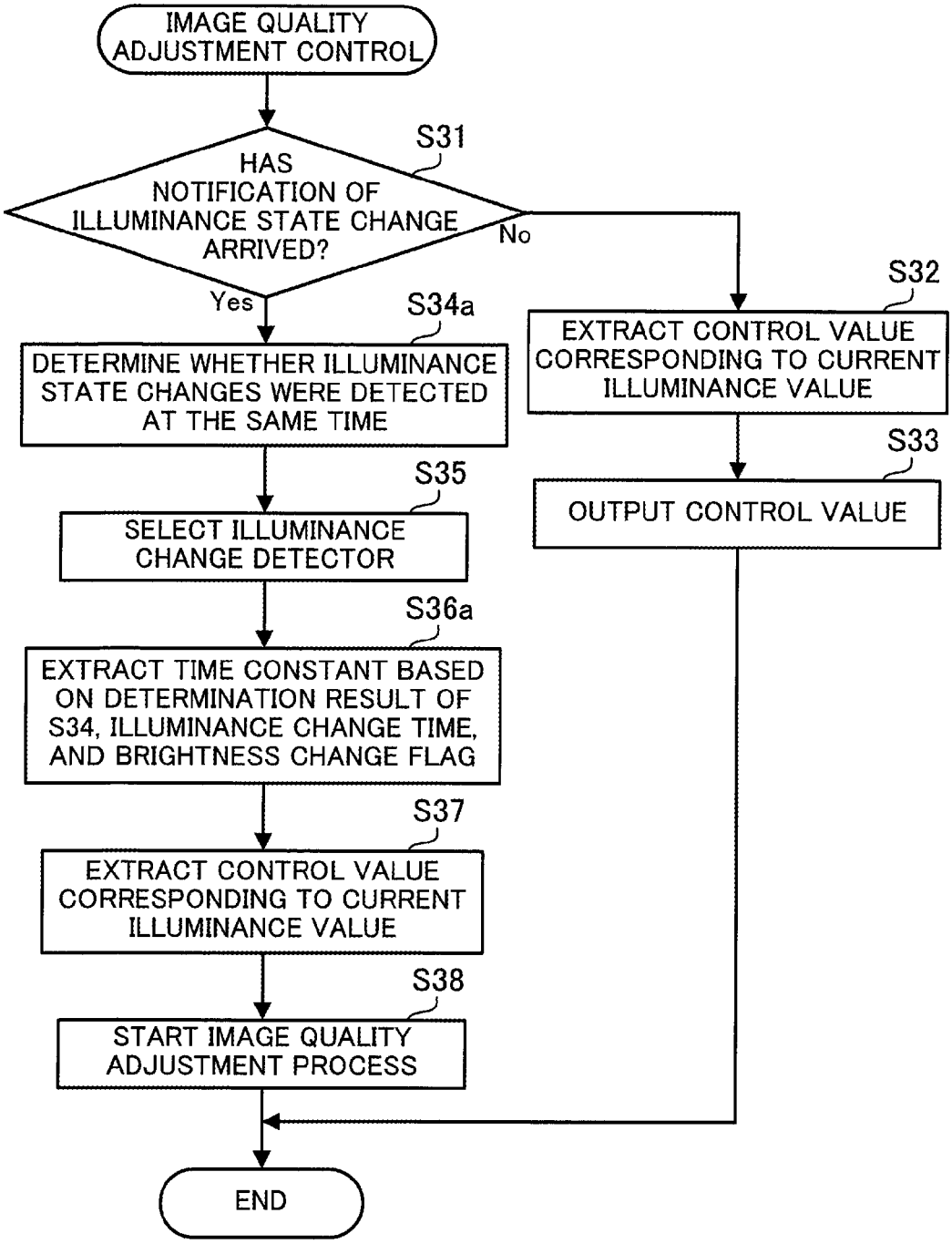
FIG. 12 is a flowchart illustrating a process performed by an image quality adjustment controller according to the third embodiment.

FIG. 12 is a flowchart illustrating a process performed by an image quality adjustment controller according to the third embodiment.

In FIG. 12, the same reference numerals as in FIG. 8 are applied to the same processing steps, and only different processing steps from FIG. 8 will be described. In place of steps S34 and S36 of FIG. 8, steps S34*a* and S36*a* are executed in the process illustrated in FIG. 12.

(Step S34*a*) The image quality adjustment controller 145 determines whether illuminance state changes were detected by all of the illuminance change detectors 141 to 144 at the same time. More specifically, for example, the image quality adjustment controller 145 determines whether or not all of the illuminance change detectors 141 to 144 made a notification of illuminance state change at the same time and outputted the same illuminance change time, the same current illuminance value, and the same value of the brightness change flag.

(Step S36*a*) The time constant table 161 stores a time constant to be used for changing a control value set in the image quality adjustment unit 152 for each combination of an illuminance change time, illuminance change flag, and brightness change flag. The image quality adjustment controller 145 extracts, from the time constant table 161, a time constant that matches the determination result obtained at step S34*a*, the illuminance change time and brightness change flag output from the illuminance change detector selected at step S35.

FIG. 13 illustrates an example of data stored in a time constant table according to the third embodiment.

The time constant table 161 according to this embodiment stores a time constant for each combination of an illuminance change time, illuminance change flag, and brightness change flag. Referring to the example of FIG. 13, there are three ranges for illuminance change time, as in FIG. 9. In addition, in the time constant table 161 of this embodiment, with respect to each illuminance change time range other than that including the shortest time (other than the range equal to or lower than D1), the upper limit value of the illuminance change time range is set as a time constant associated with an illuminance change flag of "1" and a time period longer than the illuminance change time is set as a time constant associated with an illuminance change flag of "0".

In the time constant table 161 of FIG. 13, with respect to the illuminance change range including the shortest time (the range equal to or lower than D1) and the illuminance change flag of "1", a different time constant is set depending on a value of the brightness change flag. With respect to an illuminance change time of D1 or lower and the illuminance change flag of "1", the time constant table 161 stores D1 as a time constant associated with a brightness change flag of "0" (that is, the case where an illuminance value increased), and stores (D1+F1) longer than D1 as a time constant associated with a brightness change flag of "1" (that is, the case where the illuminance value decreased).

The case where the illuminance change time is short and the illuminance change flag is "1" may be a case where a movement is made from a very bright environment like a place with sunlight to a very dark environment like a place in a tunnel in a very short time. In the case where the illuminance change time is D1 or lower, the illuminance change flag is "1" and the brightness change flag is "1", it is expected that the illuminance values detected by all of the illuminance sensors 121 to 124 greatly decreased in a short time. Therefore, by setting a time constant longer than that associated with the brightness change flag of "0", which indicates a movement from a dark environment to a bright environment, the image quality adjustment value is changed more gradually, so as to realize image quality adjustment that fits the adaptation of the human visual system.

In this connection, in association with the illuminance change time of D1 or lower, a time constant longer than D1 is set irrespective of the value of the brightness change flag. E1 and F1 in FIG. 13 may be set to the same value or different values, for example.

In this third embodiment, an image quality adjustment value may be controlled based on an illuminance change rate, instead of an illuminance change time. In this approach, ranges for illuminance change rate may be set in the time constant table 161 of FIG. 13, instead of the ranges for illuminance change time, and a shorter time constant may be set for a higher illuminance change rate.

In addition, in the third embodiment, the image quality adjustment controller 145 may delay, by the time period indicated by a time constant, timing of changing a control value to a control value corresponding to an illuminance value obtained after an illuminance state changes, as in the case explained with reference to FIG. 10. Further, at step S38 of FIG. 12, the image quality adjustment controller 145 may change an image quality adjustment value at a time by outputting the control value extracted at step S37 to the image quality adjustment unit 152 after the time period indicated by the time constant passes.

Fourth Embodiment

For example, when the display panel 110 moves from a very bright environment like a place with sunlight to a very dark environment like a place in a tunnel, and vise-versa, the illuminance varies greatly, compared with the case where the display panel 110 moves into the shadow of the clouds or buildings. For example, the outdoor illuminance for sunny sky without clouds is about 50,000 lux, whereas the illuminance in a tunnel is as high as several hundreds lux. An illuminance difference between them is as close as 50,000 lux. On the other hand, the illuminance in a shadow area of buildings under sunny sky without clouds is 15,000 lux at most. Therefore, an illuminance difference caused by moving from a place under sunlight into a shadow area of buildings is about 35,000 lux, which is greatly smaller than that caused by moving in a tunnel.

In addition, basically, when the display panel 110 moves from a very bright environment like a place with direct sunlight to a very dark environment like a place in a tunnel, and vise-versa, the visibility of a display image is improved by changing an image quality adjustment value as fast as possible. On the other hand, when an illuminance value varies relatively small, such as when the display panel 110 moves into the shadow of the clouds or buildings, it is better to change the image quality adjustment value gradually in order to make an image natural to view. In this fourth embodiment, an image quality adjustment value is determined based on an illuminance change amount obtained when an illuminance state change occurs.

An image display apparatus according to the fourth embodiment may basically be configured as illustrated in FIG. 3. Therefore, the following description refers to FIG. 3. Different features from the second embodiment are that each of illuminance change detectors 141 to 144 is designed to detect an illuminance change amount, instead of an illuminance change time, a time constant table 161 stores a different time constant for a different illuminance change amount, and an image quality adjustment controller 145 determines a control value taking the illuminance change amount into account.

Figure 14:
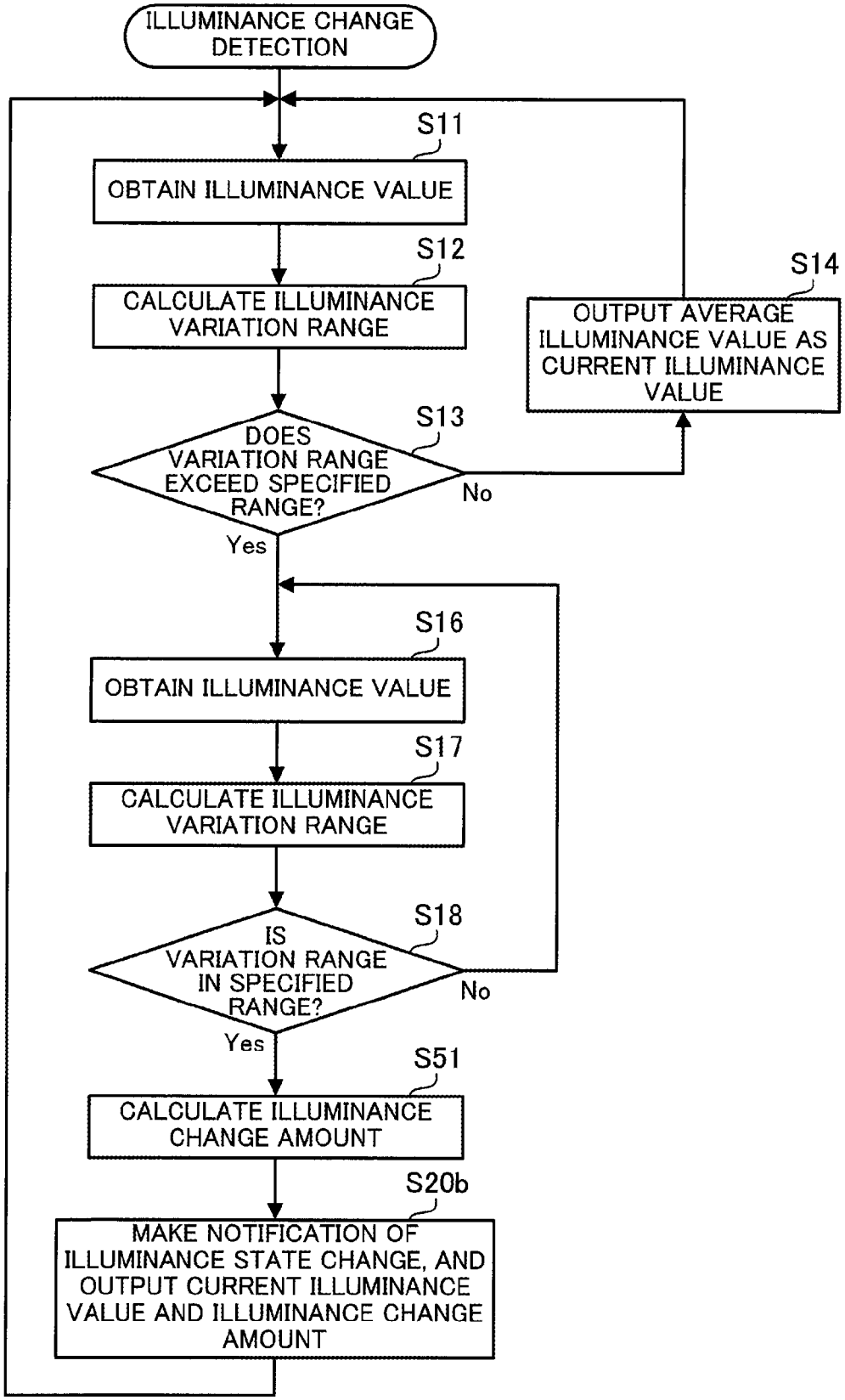
FIG. 14 is a flowchart illustrating a process performed by an illuminance change detector according to a fourth embodiment.

FIG. 14 is a flowchart illustrating a process performed by an illuminance change detector according to the fourth embodiment.

Similarly to FIG. 7, FIG. 14 will be described using the illuminance change detector 141 as a representative of the illuminance change detectors 141 to 144. In addition, in FIG. 14, the same reference numerals as in FIG. 7 are applied to the same processing steps, and only different processing steps from FIG. 7 will be described. In the process of FIG. 14, steps S15 and S19 of FIG. 7 are not executed, and in place of step S20 of FIG. 7, steps S51 and S20*b* are executed. That is, step S16 is executed when the determination of step S13 results in yes, and step S51 is executed when the determination of step S18 results in yes.

(Step S51) After detecting an illuminance state change (S18), the illuminance change detector 141 calculates a difference between illuminance values obtained most recently at steps S11 and S16 to thereby obtain an illuminance change amount.

(Step S20*b*) The illuminance change detector 141 notifies the image quality adjustment controller 145 of the illuminance state change, and outputs the current illuminance value to the image quality adjustment controller 145, as in step S20 of FIG. 7. In addition, the illuminance change detector 141 outputs the illuminance change amount calculated at step S51 to the image quality adjustment controller 145.

Figure 15:
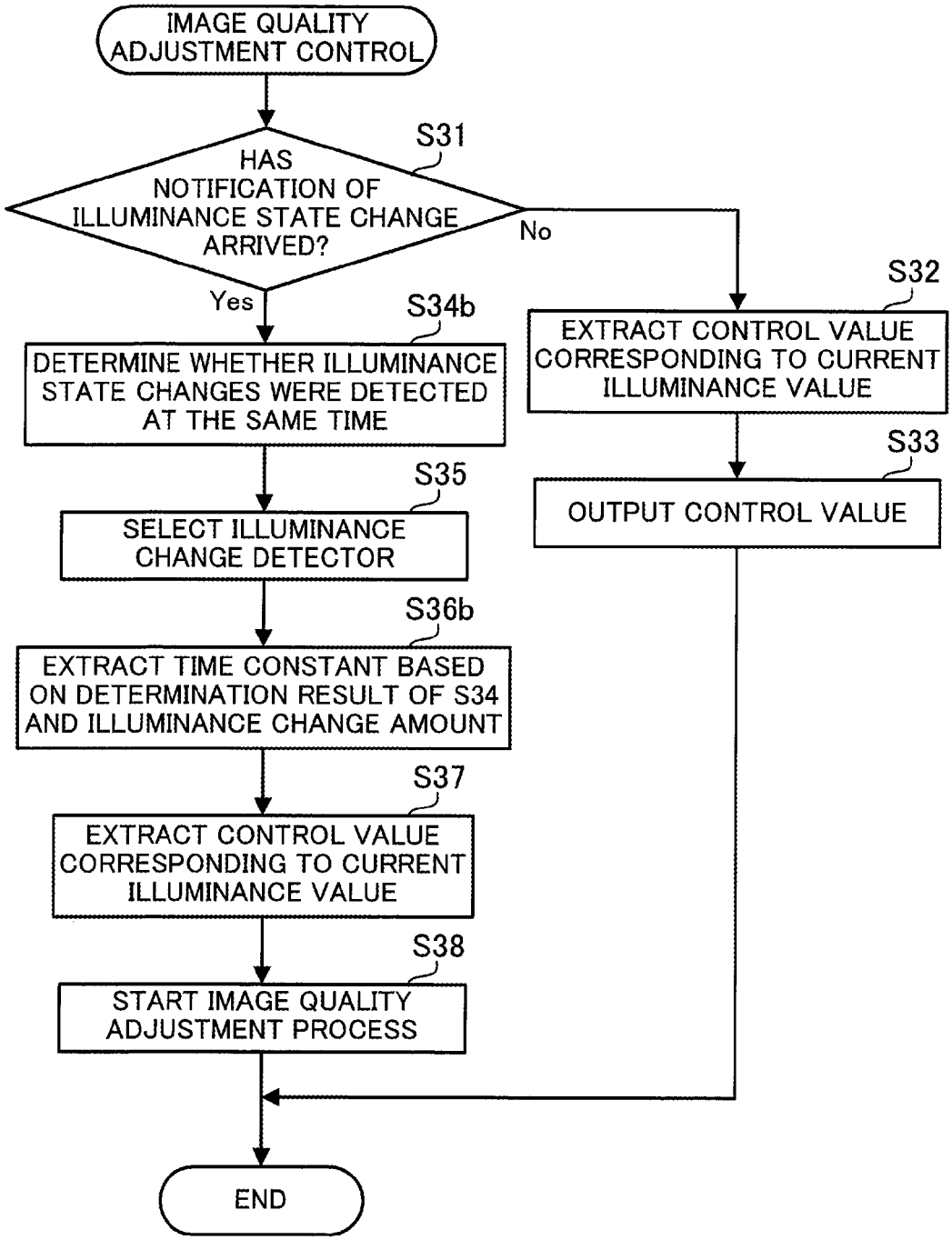
FIG. 15 is a flowchart illustrating a process performed by an image quality adjustment controller according to the fourth embodiment.

FIG. 15 is a flowchart illustrating a process performed by an image quality adjustment controller according to the fourth embodiment.

In FIG. 15, the same reference numerals as in FIG. 8 are applied to the same processing steps, and only different processing steps from FIG. 8 will be described. In place of steps S34 and S36 of FIG. 8, steps S34*b* and S36*b* are executed in the process illustrated in FIG. 15.

(Step S34*b*) The image quality adjustment controller 145 determines whether or not illuminance state changes were detected by all of the illuminance change detectors 141 to 144 at the same time. More specifically, for example, the image quality adjustment controller 145 determines whether or not all of the illuminance change detectors 141 to 144 made a notification of illuminance state change at the same time and outputted the same current illuminance value and the same illuminance change amount.

(Step S36*b*) The time constant table 161 stores a time constant to be used for changing a control value set in the image quality adjustment unit 152, for each combination of an illuminance change flag and an illuminance change amount. The image quality adjustment controller 145 extracts, from the time constant table 161, a time constant that matches the determination result obtained at step S34*b* and an illuminance change amount output from the illuminance change detector selected at step S35.

FIG. 16 illustrates an example of data stored in a time constant table according to the fourth embodiment.

The time constant table 161 of this embodiment stores an operation formula for calculating a time constant, for each combination of an illuminance change flag and an illuminance change amount range. Referring to the time constant table 161 of FIG. 16, there are three ranges for illuminance change amount by way of example. The illuminance change amount ranges have a relationship of G1>G2. H1, H2, and H3 in the time constant column in FIG. 16 have a relationship of H1<H2<H3. That is to say, referring to the time constant table 161 of FIG. 16, a longer time constant is set for a smaller illuminance change amount, so that an image quality adjustment value is changed gradually. This makes a display image more natural to view.

In this connection, for example, H1, H2, and H3 in FIG. 16 may have the same values as D1, D2, and D3 of FIG. 9, respectively. Alternatively, instead of H1, H2, and H3 that are fixed values, an actual measurement value of an illuminance change time may be used. The illuminance change time may be measured in the same way as described in the second embodiment.

In addition, with respect to each illuminance change amount range, the time constant table 161 of FIG. 16 stores a longer time constant for an illuminance change flag of "0" than that for an illuminance change flag of "1". For example, assume that an illuminance change amount is large, and an illuminance change flag is "0" that indicates that a large variation in illuminance value was detected only in some of the illuminance sensors 121 to 124. In this case, considering a wide area covering the positions of all of the illuminance sensors 121 to 124, the illuminance value is expected to have varied by the detected illuminance change amount over a longer time period, compared with the case where a large variation in illuminance value was detected in all of the illuminance sensors 121 to 124. Or, an illuminance value may be expected to have made a transient change due to moving of the display panel 110 into the shadow of the clouds or buildings. In either case, more gradually changing the image quality adjustment value for a display image makes the display image on the display panel 110 more natural to view.

In this connection, I1, I2, and I3 in FIG. 16 may be set to the same value or to have a relationship of I1<I2<I3, for example. In addition, as time constant values, H1 may be set to several tens milliseconds, and H3+I3 may be set to several tens seconds, for example.

In addition, in this fourth embodiment, the image quality adjustment controller 145 may delay, by the time period indicated by a time constant, timing of changing a control value to a control value corresponding to an illuminance value obtained after an illuminance state changes, as in the case explained with reference to FIG. 10. Further, at step S38 of FIG. 15, the image quality adjustment controller 145 may change an image quality adjustment value at a time by outputting the control value extracted at step S37 to the image quality adjustment unit 152 after the time period indicated by the time constant passes.

Fifth Embodiment

In the image display apparatus 100 illustrated in FIG. 3, the processing functions of the control circuit 140 for calculating an image quality adjustment value are provided together with the display panel 110. Alternatively, the processing functions of the control circuit 140 may be provided in an apparatus separate from the display panel 110, as illustrated in FIG. 17.

Figure 17:
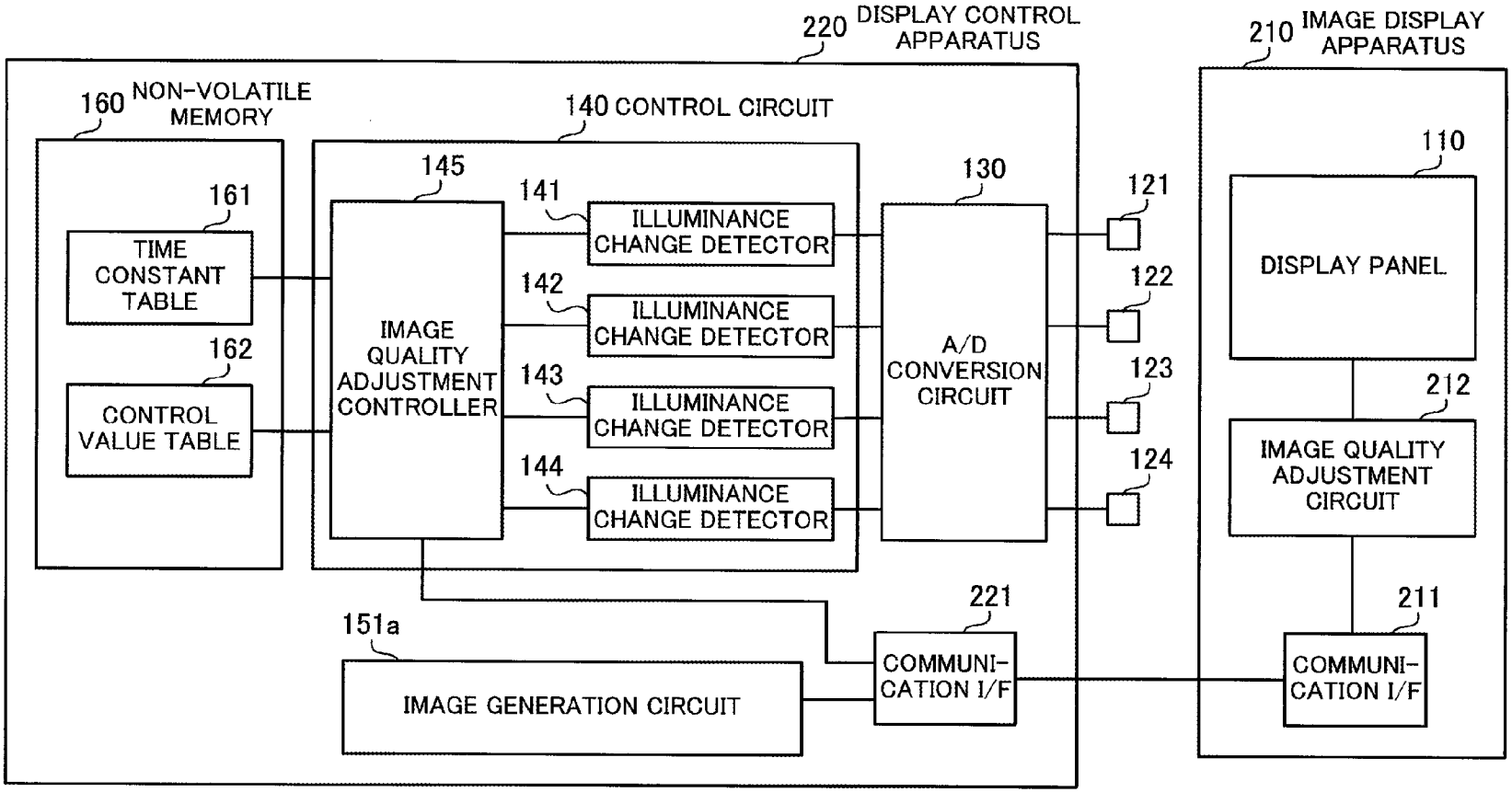
FIG. 17 illustrates an example of a functional configuration of an image display system according to a fifth embodiment.

FIG. 17 illustrates an example of a functional configuration of an image display system according to the fifth embodiment. In FIG. 17, the same reference numerals as in FIG. 3 are applied to the same processing blocks.

Referring to FIG. 17, an image display apparatus 210 includes a display panel 110, a communication interface (I/F) 211, and an image quality adjustment circuit 212. The communication interface 211 communicates data with a display control apparatus 220. The image quality adjustment circuit 212 performs the same processes as the image quality adjustment unit 152 of FIG. 3, to adjust the image quality of an image displayed on the display panel 110. The image quality adjustment circuit 212 receives a control value for an image quality adjustment value and the signal of an input image whose image quality is to be adjusted, from the external display control apparatus 220 via the communication interface 211.

This image display apparatus 210 may be implemented as a display apparatus included in a car navigation system or a display apparatus for displaying various kinds of information that is installed in a vehicle instrument panel.

On the other hand, the display control apparatus 220 includes an analog-to-digital (A/D) conversion circuit 130, a control circuit 140, non-volatile memory 160, an image generation circuit 151*a*, and a communication interface 221.

The A/D conversion circuit 130 converts a detection signal of an illuminance value detected by each of external illuminance sensors 121 to 124 into a digital signal, and outputs the digital signal to the control circuit 140. In this connection, the illuminance sensors 121 to 124 and the A/D conversion circuit 130 may be provided in the image display apparatus 210, for example. In this case, the control circuit 140 may receive a signal obtained by digitalizing a detection signal detected by each of the illuminance sensors 121 to 124 from the image display apparatus 210 via the communication interface 221.

The image generation circuit 151*a* performs the same processes as the image generation unit 151 of FIG. 3. The communication interface 221 communicates data with the image display apparatus 210. For example, the communication interface 221 transmits an image signal output from the image generation circuit 151*a* and a control value output from an image quality adjustment controller 145 of the control circuit 140, to the image display apparatus 210.

In this connection, the image generation circuit 151*a* may be provided external to the display control apparatus 220.

In the display control apparatus 220 of FIG. 17, the control circuit 140 performs the same processes as the control circuit 140 of any one of the above-described second to fourth embodiments, to control the image quality adjustment process performed by the image quality adjustment circuit 212 so as to make an image displayed on the display panel 110 natural to view with high visibility, irrespective of the surrounding illuminance.

Sixth Embodiment

Figure 18:
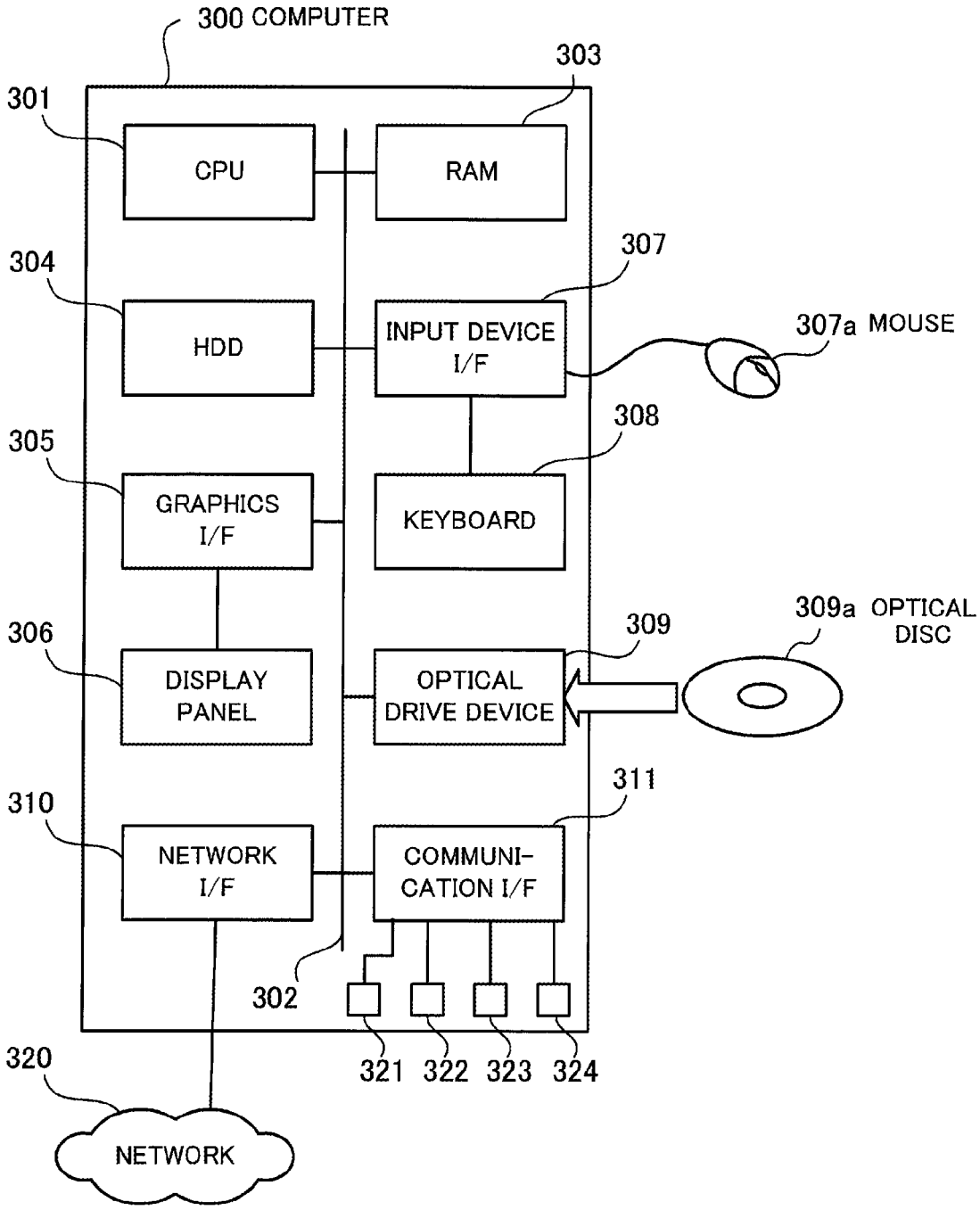
FIG. 18 illustrates an example of a configuration of a computer according to a sixth embodiment.

FIG. 18 illustrates an example of a configuration of a computer according to a sixth embodiment.

The processes to be performed by the image display apparatus 100 of FIG. 3 may be implemented by a computer 300 illustrated in FIG. 18. This computer 300 is entirely controlled by a CPU 301. This CPU 301 is connected to a RAM 303 and a plurality of peripheral devices via a bus 302.

The RAM 303 is used as a main memory device of the computer. The RAM 303 temporarily stores at least part of Operating System (OS) programs and application programs to be executed by the CPU 301. The RAM 102 also stores various data to be used while the CPU 301 operates.

The peripheral devices connected to the bus 302 include an HDD 304, graphics interface (I/F) 305, input device interface 307, optical drive device 309, network interface 310, and communication interface 311.

The HDD 304 magnetically writes and reads data on an internal magnetic disk. The HDD 304 is used as a secondary storage device of the computer. The HDD 304 stores the OS programs, application programs, and various data. In this connection, a flash memory or another kind of semiconductor storage device may be used as a secondary storage device.

The graphics interface 305 is connected to a display panel 306. The graphics interface 305 displays an image on the display panel 306 under the control of the CPU 301. In this connection, the display panel 306 may be provided external to the computer 300.

The input device interface 307 is connected to a keyboard 308. In addition, a mouse 307*a* which is provided external to the computer 300 may be connected to the input device interface 307, for example. The input device interface 307 transfers signals from the keyboard 308 and mouse 307*a* to the CPU 301. In this connection, the mouse 307*a* is one example of a pointing device, and another kind of pointing device such as a touch panel, tablet, touchpad, or trackball may be used.

The optical drive device 309 reads data from an optical disc 309*a* using laser light or the like. The optical disc 309*a* is a portable recording medium on which data is recoded so as to be read with reflection of light. Optical discs 309*a* include Digital Versatile Disc (DVD), DVD-RAM, Compact Disc Read Only Memory (CD-ROM), CD-R (Readable)/RW (Re-Writable), etc.

The network interface 310 is connected to a network 320. The network interface 310 performs data communications with other computers or communication apparatuses via the network 320.

The communication interface 311 is connected to illuminance sensors 321 to 324. The communication interface 311 transfers the detected values of illuminance values received from the illuminance sensors 321 to 324 to the CPU 301 via the bus 302. The illuminance sensors 321 to 324 are mounted around the display panel 306, for example. In this connection, each of the illuminance sensors 321 to 324 converts the detection signal of an illuminance value to a digital signal, and outputs the digital signal to the communication interface 311.

By executing intended programs, this computer 300 realizes the processes that are performed by the control circuit 140 and image processing circuit 150 of the image display apparatus 100 illustrated in FIG. 3. In this connection, the processes performed by the control circuit 140 in any one of the above-described second to fourth embodiments may be realized here. In addition, for example, the processes of the image quality adjustment unit 152 of FIG. 3 may be performed by the graphics interface 305, and the image quality adjustment process performed by the graphics interface 305 may be controlled by the CPU 301.

In this connection, the processes performed by the display control apparatus 220 and image display apparatus 210 illustrated in FIG. 17 may be implemented by using computers configured as illustrated in FIG. 18.

The processing functions of the above-described image display apparatus 100, display control apparatus 220, and image display apparatus 210 may be implemented by using a computer. In this case, a program is prepared, which describes processes for the functions of the image display apparatus 100. A computer realizes the above processing functions by executing the program. The program describing the intended processes may be recorded on a computer-readable recording medium. Computer-readable recording media include magnetic recording devices, optical discs, magneto-optical recording media, semiconductor memories, etc. The magnetic recording devices include HDDs, Flexible Disks (FD), Magnetic Tapes, etc. The optical discs include DVDs, DVD-RAMs, CD-ROM/RW, etc. The magneto-optical recording media include MOs (Magneto-Optical disk), etc.

To distribute the program, portable recording media, such as DVDs and CD-ROMs, on which the program is recorded, may be put on sale. Alternatively, the program may be stored in the storage device of a server computer and may be transferred from the server computer to other computers over a network.

A computer which is to execute the above program stores in its local storage device the program recorded on a portable recording medium or transferred from the server computer, for example. Then, the computer reads the program from the local storage device, and runs the program. The computer may run the program directly from the portable recording medium. Also, while receiving the program being transferred from the server computer over a network, the computer may sequentially run this program.

In addition, the above-described processing functions may also be implemented wholly or partly by using DSP, application-specific integrated circuit (ASIC), programmable logic device (PLD), or other electronic circuits.

The above-described image display apparatus, display control apparatus, and display control method make it possible to adjust the image quality of a display apparatus according to changes in the surrounding environment of the display apparatus so as to make the screen natural to view.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that various changes, substitutions, and alterations could be made hereto without departing from the spirit and scope of the invention.

What is claimed is:

1. An image display apparatus comprising:

a display unit configured to display an image;

an image quality adjustment unit configured to adjust an image quality of the display unit;

an illuminance change detector configured to obtain a detected illuminance value from each of a plurality of illuminance detectors that detect illuminance values outside the display unit, and to determine whether the illuminance value detected by said each illuminance detector changed from one illuminance range to another illuminance range; and an image quality control unit configured to set, upon determining by the illuminance change detector that the illuminance values detected by one or more of the plurality of illuminance detectors changed from the one illuminance range to said another illuminance range, different timing to change an image quality adjustment value set in the image quality adjustment unit from an image quality adjustment value corresponding to the one illuminance range to an image quality adjustment value corresponding to said another illuminance range, depending on how many of the illuminance values detected by the plurality of illuminance detectors changed from the one illuminance range to said another illuminance range.

2. The image display apparatus according to claim 1, wherein the image quality control unit sets a longer time period to change the image quality adjustment value set in the image quality adjustment unit to the image quality adjustment value corresponding to said another illuminance range in response to determining that the illuminance values detected by some of the plurality of illuminance detectors changed from the one illuminance range to said another illuminance range than in response to determining that the illuminance values detected by all of the plurality of illuminance detectors changed from the one illuminance range to said another illuminance range.

3. The image display apparatus according to claim 1, wherein, upon determining that the illuminance values detected by one or more of the plurality of illuminance detectors changed from a first state to a second state, the image quality control unit sets more different timing to change the image quality adjustment value set in the image quality adjustment unit to the image quality adjustment value corresponding to said another illuminance range, according to a difference in illuminance value between the first state and the second state, the first state being a state where an illuminance value falls in the one illuminance range for a fixed time period, the second state being a state where an illuminance value falls in said another illuminance range for the fixed time period.

4. The image display apparatus according to claim 3, wherein the image quality control unit sets a longer time period to change the image quality adjustment value set in the image quality adjustment unit to the image quality adjustment value corresponding to said another illuminance range, in response to a smaller difference in illuminance value between the first state and the second state.

5. The image display apparatus according to claim 1, wherein:

the illuminance change detector further detects a change time taken for the illuminance value detected by said each illuminance detector to change from the one illuminance range to said another illuminance range; and upon determining that the illuminance values detected by one or more of the plurality of illuminance detectors changed from the one illuminance range to said another illuminance range, the image quality control unit sets more different timing to change the image quality adjustment value set in the image quality adjustment unit to the image quality adjustment value corresponding to said another illuminance range, according to the change time detected by the illuminance change detector.

6. The image display apparatus according to claim 5, wherein the image quality control unit sets a longer time period to change the image quality adjustment value set in the image quality adjustment unit to the image quality adjustment value corresponding to said another illuminance range, in response to detecting a longer change time by the illuminance change detector.

7. The image display apparatus according to claim 6, wherein the image quality control unit sets a time period to change the image quality adjustment value set in the image quality adjustment unit to the image quality adjustment value corresponding to said another illuminance range such that the time period is longer than or equal to the change time detected by the illuminance detector.

8. The image display apparatus according to claim 7, wherein the image quality control unit sets the time period such that there has a greater difference between the time period and the change time as the change time is longer.

9. The image display apparatus according to claim 1, wherein:

the illuminance change detector further determines whether the illuminance value detected by said each illuminance detector increased or decreased; and upon determining that the illuminance values detected by all of the plurality of illuminance detectors changed from the one illuminance range to said another illuminance range, the image quality control unit sets a longer time period to change the image quality adjustment value set in the image quality adjustment unit to the image quality adjustment value corresponding to said another illuminance range in response to determining by the illuminance change detector that the illuminance values detected by the plurality of illuminance detectors decreased than in response to determining that the illuminance values increased.

10. The image display apparatus according to claim 9, wherein:

the illuminance change detector further detects a change time taken for the illuminance value detected by said each illuminance detector to change from the one illuminance range to said another illuminance range; and upon determining that the illuminance values detected by all of the plurality of illuminance detectors changed from the one illuminance range to said another illuminance range and that the change time detected by the illuminance change detector is equal to or lower than a predetermined value, the image quality control unit sets a longer time period to change the image quality adjustment value set in the image quality adjustment unit to the image quality adjustment value corresponding to said another illuminance range in response to determining by the illuminance change detector that the illuminance values detected by the plurality of illuminance detectors decreased than in response to determining that the illuminance values increased.

11. The image display apparatus according to claim 1, wherein, upon determining that the illuminance values detected by one or more of the plurality of illuminance detectors changed from the one illuminance range to said another illuminance range, the image quality control unit continuously changes the image quality adjustment value set in the image quality adjustment unit to the image quality adjustment value corresponding to said another illuminance range.

12. The image display apparatus according to claim 1, wherein, upon determining that the illuminance values detected by one or more of the plurality of illuminance detector changed from the one illuminance range to said another illuminance range, the image quality control unit delays, by a delay time, changing the image quality adjustment value set in the image quality adjustment unit to the image quality adjustment value corresponding to said another illuminance range, wherein the delay time for delaying the changing of the image quality adjustment value set in the image quality adjustment unit to the image quality adjustment value corresponding to said another illuminance range is different depending on how many of the illuminance values detected by the plurality of illuminance detectors changed from the one illuminance range to said another illuminance range.

13. The image display apparatus according to claim 1, wherein the plurality of illuminance detectors are integrally mounted.

14. A display control apparatus comprising:

an illuminance change detector configured to obtain a detected illuminance value from each of a plurality of illuminance detectors that detect illuminance values outside a display apparatus, and to determine whether the illuminance value detected by said each illuminance detector changed from one illuminance range to another illuminance range; and an image quality control unit configured to set, upon determining by the illuminance change detector that the illuminance values detected by one or more of the plurality of illuminance detectors changed from the one illuminance range to said another illuminance range, different timing to change an image quality adjustment value for a display image to be displayed on the display apparatus from an image quality adjustment value corresponding to the one illuminance range to an image quality adjustment value corresponding to said another illuminance range, depending on how many of the illuminance values detected by the plurality of illuminance detectors changed from the one illuminance range to said another illuminance range.

15. A display control method comprising:

obtaining, by a display control apparatus, a detected illuminance value from each of a plurality of illuminance detectors that detect illuminance values outside a display apparatus, and determining whether the illuminance value detected by said each illuminance detector changed from one illuminance range to another illuminance range; and setting, by the display control apparatus, upon determining that the illuminance values detected by one or more of the plurality of illuminance detectors changed from the one illuminance range to said another illuminance range, different timing to change an image quality adjustment value for a display image to be displayed on the display apparatus from an image quality adjustment value corresponding to the one illuminance range to an image quality adjustment value corresponding to said another illuminance range, depending on how many of the illuminance values detected by the plurality of illuminance detectors changed from the one illuminance range to said another illuminance range.

* * * * *